US006025859A

United States Patent [19]

Ide et al.

[11] Patent Number: 6,025,859

[45] **Date of Patent: *Feb. 15, 2000**

[54] ELECTROSTATIC PRINTER HAVING AN ARRAY OF OPTICAL MODULATING GRATING VALVES

[75] Inventors: Atsushi Ide, Nara; Hideo Yamasa, Yamatokoriyama; Yoichi Yamamoto, Nara, all of Japan

[73] Assignee: Sharp Kabushiki Kaisha, Osaka, Japan

[21] Appl. No.: 08/788,319

[22] Filed: Dec. 24, 1996

[30] Foreign Application Priority Data

Dec. 27, 1995 [JP] Japan ..... 7-341889
Dec. 28, 1995 [JP] Japan ..... 7-344226

[51] Int. Cl.[7] ..... B41J 2/415; B41J 2/385; G03G 13/04

[52] U.S. Cl. ..... 347/135

[58] Field of Search ..... 347/154, 112, 347/123, 134, 239, 241, 244, 135; 399/5, 51, 177, 220

[56] References Cited

U.S. PATENT DOCUMENTS 4,460,907 7/1984 Nelson ..... 347/154
5,299,289 3/1994 Omae et al. .
5,311,360 5/1994 Bloom et al. .

FOREIGN PATENT DOCUMENTS 234767 9/1988 Japan .
333015 11/1992 Japan .

OTHER PUBLICATIONS

Apte, et al. "Grating Light Valves For High Resolution Displays", Solid State Sensors and Actuators Workshop, Hilton Head Island, SC, Jun. 13–16, 1994, pp. 1–7.

*Primary Examiner*—John Barlow
*Assistant Examiner*—Raquel Yvette Gordon
*Attorney, Agent, or Firm*—Nixon & Vanderhye P.C.

[57] ABSTRACT

An image forming apparatus includes a grating light valve (GLV) optical modulating device for modulating light projected by a monochromatic light source unit so that the light thus modulated is projected onto a photosensitive drum. This arrangement enables printing at a higher speed and high-quality printing using half tone. In the GLV optical modulator, a first GLV element row and a second GLV element row, each having a plurality of GLV elements provided at spaces, each space being smaller than a width of each GLV element, are provided parallel so that GLV elements constituting the first and second element rows are provided in a staggered manner.

15 Claims, 22 Drawing Sheets

X-AXIS CROSS SECTION y-AXIS CROSS SECTION

36b

37

37

37

37

37
2725
2727

2726

ELECTROSTATIC PRINTER HAVING AN ARRAY OF OPTICAL MODULATING GRATING VALVES

FIELD OF THE INVENTION

The present invention relates to an image forming apparatus utilizing an optical modulator, such as an optical printer, or a copying machine.

BACKGROUND OF THE INVENTION

Today, printers utilizing optical modulators, including laser printers utilizing electrophotographic technology, are widely used as printers connected to personal computers and networks, and also as digital copying machines, digital printers, color copying machines, color printers, or the like. The printers of this type are called optical printers, since in each printer, image formation is controlled by controlling pixel units for forming characters and images by ON/OFF control of optical power.

As means for the ON/OFF control of the optical power in the optical printer, a laser diode array or a light emitted diode (LED) array is used.

For example, a writing optical system which is composed of laser diodes and a rotary polygon scanner is widely used as a writing optical system for use in a laser printer having a low or medium printing speed, such as a printer having a printing speed not higher than 40 PPM (page per minute) in the case where A4/letter size paper is used and the resolution degree is 600 DPI (dot per inch).

But, the recent demands for a higher printing speed and a high-quality printing in half tones cannot be met by the writing optical system composed of laser diodes and a rotary polygon scanner since the switching speed of laser diodes is not sufficiently high and the technology of rotating the rotary polygon scanner at a high speed is insufficient, and this becomes a serious problem. Note that a writing optical system utilizing an LED array is expected to have a high speed since writing is conducted based on parallel exposure system, but there is a problem that luminances of individual LEDs are not uniform.

However, another optical modulator with which these problems may be possibly solved has recently been disclosed for the use in a display apparatus (see the U.S. Pat. No. 5,311,360, and Solid State Sensors and Actuators Workshop, Hilton Head Island, S.C., Jun. 13–16, 1994). This is a micromachine phase diffraction grating utilizing diffraction of light, which is called grating light valve (hereinafter referred to as GLV) element. By utilizing the GLV element, it is possible to electrically control the optical ON/OFF control. In addition, by using the GLV element, a digital optical modulator can be realized which may be substituted for the rotary polygon scanner.

However, no consideration has been made on using the GLV elements disclosed in the above patent specification and other publications as a writing device in an optical printer.

SUMMARY OF THE INVENTION

The first object of the present invention is to provide an image forming apparatus which enables printing at a higher speed and high-quality printing using half tone.

The Applicant of the present invention and others examined to use grating light valve (GLV) elements as an optical modulator in an image forming apparatus, so as to achieve the first object.

In the case where a necessary number of GLV elements lined in a single row constitutes the optical modulator of the image forming apparatus, the row of the GLV elements is too long, thereby causing the optical modulator too bulky and deteriorating the yield of the optical modulators. Besides, light quantity is insufficient in the edge parts of each GLV element, thereby causing the quality of printed pictures to be lowered.

Therefore, the second object of the present invention is to provide an image forming apparatus having an optical modulator composed of GLV elements, and to miniaturize the optical modulator and to improve the yield of the optical modulator, as well as to improve the quality of printed pictures.

To achieve the first and second objects, the image forming apparatus of the present invention comprises (1) an image carrier whose surface is movable, (2) an exposure unit for forming an electrostatic latent image on the image carrier, the exposure unit including a light source for emitting light and an optical modulator for modulating light from the light source, the modulated light being projected on the image carrier so as to form the electrostatic latent image thereon, (3) a development unit for developing the electrostatic latent image so as to form a visual image, and (4) a transfer unit for transferring the visual image onto recording material, wherein:

the optical modulator includes a first element row composed of a plurality of grating light valve (GLV) elements and a second element row composed of a plurality of GLV elements, the first and second element rows being provided parallel to each other and provided in a direction orthogonal to a moving direction of the surface of the image carrier; and the GLV elements in the first and second element rows are provided in a staggered manner such that each line extending from a center of each element of the second element row perpendicularly to a center line of the first element row runs between neighboring GLV elements of the first element row, and such that in each of the first and second element rows the GLV elements are provided at spaces, each space being smaller than a width of each GLV element in a longitudinal direction of the first element row.

According to the above first arrangement, the light emitted from the light source is modulated by the GLV element row composed of the GLV elements lined in a direction orthogonal to the moving direction of the image carrier surface, and a row of projective light images formed by the respective GLV elements is formed in the direction orthogonal to the moving direction of the image carrier surface, on the image carrier. As a result, the printing at a higher speed can be realized which the conventional optical modulator composed of the polygon scanner has not been able to do, while the high-quality printing using half tone can be realized as well.

According to the first arrangement described above, the necessary number of the GLV elements are divided into the first element row and the second element row, and the first and second element rows are provided parallel, while in each of the first and second element rows, the GLV elements are provided at spaces, each space being smaller than the width of each GLV element in the longitudinal direction of the first element row, that is, each of distances between centers of the neighboring GLV elements being smaller than twice of the GLV element width in the longitudinal direction of the first element row. Therefore, the total length of the first and second element rows is set shorter than that in the case where the necessary number of GLV elements are lined in a single row.

Therefore, in the image forming apparatus having the optical modulator composed of the GLV elements, the necessary number of GLV elements can be provided so that the total length of the element rows become shorter. This enables the miniaturization of the optical modulator, and the improvement of the yield of the optical modulators.

In addition, according to the first arrangement, the first and second element rows are provided so that the GLV elements in the first and second element rows are provided in a staggered manner such that each line extending from a center of each element of the second element row perpendicularly to a center line of the first element row runs between neighboring GLV elements of the first element row, and such that in each of the first and second element rows the GLV elements are provided respectively at spaces, each space being smaller than a width of each GLV element in a longitudinal direction of the first element row. With this arrangement, every one of the GLV elements constituting the first element row overlaps two of those constituting the second element row provided in the moving direction of the image carrier direction, so that a central part of a GLV element in one of the element rows overlaps peripheral parts of neighboring GLV elements in the other element row, namely, the parts along the borders therebetween or the parts around gaps therebetween.

With this arrangement, insufficiency of light quantity in the peripheral parts of the GLV elements in one element row can be compensated by the light of the GLV elements in the other element row which abut the peripheral parts. As a result, the deterioration of the image quality caused by the insufficiency of the light quantity in the peripheral parts is suppressed, thereby causing the quality of printed pictures to be enhanced.

Furthermore, in the image forming apparatus of the first arrangement, it is preferable that the first and second element rows are arranged so that projective light images of each GLV element of the first and second element rows are continuously formed on the image carrier.

With this arrangement, since the projective light images of the GLV elements constituting the first and second element rows are continuously provided, the deterioration of the image quality due to the insufficiency of the light quantity in the peripheral parts of the GLV elements can be surely prevented. As a result, the quality of printed pictures can be further improved.

Besides, in the image forming apparatus of the first arrangement, it is preferable that respective effectual diffraction regions of the first and second element rows are continuously provided.

With this arrangement, since the effectual diffraction regions of the GLV elements constituting the first and second element rows are continuously provided, the deterioration of the image quality due to the insufficiency of the light quantity in the peripheral parts can be surely prevented. As a result, the quality of printed pictures can be further improved.

Furthermore, it is preferable the image forming apparatus of the first arrangement further includes an exposure control unit for turning on the GLV elements of the second element row with a delay $\Delta T$ after the GLV elements of the first element row is turned on, the delay $\Delta T$ satisfying:

$$\Delta T = L/V$$

where L represents a distance between projective light images respectively formed by the first and second element rows on the image carrier, and V represents a moving velocity of the surface of the image carrier.

With this arrangement, the exposure control unit carries out the turning on of the second element row unit with a delay after the turning on of the first element row unit, the delay corresponding to a period of time which it takes for the image carrier surface to move by a distance equal to the shift in the moving direction of the image carrier surface between the projective light images of the element rows thereon. Therefore, the exposure position of the second element row falls exactly on that of the first element row. As a result, high-resolution pictures with excellent linearity can be obtained with an apparatus having.

In the image forming apparatus of the first arrangement, it is preferable that the GLV elements abut each other in each of the first and second element rows. With this arrangement, it is further more ensured that the insufficiency of the light quantity in the parts along the borders between the GLV elements in one element row is compensated by the light of the GLV elements in the other row, since the GLV elements of one element row overlap the peripheral parts of the other element row.

Furthermore, in the image forming apparatus of the first arrangement, it is preferable that in each of the first and second element rows, the GLV elements are provided respectively at spaces, each space being not greater than a width of an effectual diffraction region of the GLV element in the longitudinal direction of the first element row. With this arrangement, it is also more ensured that the insufficiency of the light quantity caused by the peripheral parts of the GLV elements in one element row is compensated by the GLV elements in the other row, since the GLV elements of one element row abut the peripheral parts of each GLV element of the other element row.

Besides, it is preferable that the first and second element rows abut each other. With this arrangement, it is also more ensured that the insufficiency of the light quantity in the peripheral parts of the GLV elements in one element row is compensated by the light the GLV elements in the other row, since the GLV elements of one element row abut the peripheral parts of each GLV element of the other element row.

To achieve the first and second objects of the present invention, another image forming apparatus of the present invention comprises (1) an image carrier whose surface is movable, (2) an exposure unit for forming an electrostatic latent image on the image carrier, the exposure unit including a light source for emitting light and an optical modulator for modulating light from the light source, the modulated light being projected on the image carrier so as to form the electrostatic latent image thereon, (3) a development unit for developing the electrostatic latent image so as to form a visual image, and (4) a transfer unit for transferring the visual image onto recording material, wherein:

the optical modulator includes a first element row unit including at least one element row composed of a plurality of GLV elements and a second element row unit including at least one element row composed of a plurality of GLV elements, the first and second element row units forming first and second row projective light images respectively; and the exposure unit is arranged so that, when all the GLV elements are turned on, the first and second row projective light images are parallel to each other, and so that an end part of the first row projective light image and an end part of the second row projective light image in a longitudinal direction thereof overlap each other in a moving direction of the surface of the image carrier.

According to the above second arrangement, the light emitted from the light source is modulated by the GLV element rows composed of the GLV elements. As a result, the printing at a higher speed can be realized which the conventional optical modulator composed of the polygon scanner has not been able to do, while the high-quality printing using half tone can be realized as well.

With the second arrangement described above, since the necessary number of the GLV elements are divided into a plurality of element row units, the total length of the first and second element row units is set shorter than that in the case where the necessary number of GLV elements are lined in a single row. Therefore, the optical modulator can be produced by the current semiconductor technology, while the yield of the optical modulator can be improved.

Besides, since with the second arrangement the exposure unit is arranged so that the end parts of the first and second row projective light images overlap each other in a moving direction of the surface of the image carrier, the respective projective light images of the element row units are sequentially formed in the longitudinal direction, irrelevant to irregularity of individual optical unit. The pixels, namely, the element project images each being formed by each GLV element, which constitute the element row projective light images, are sequentially provided in the longitudinal direction of the element row projective light images. Therefore, even though there is irregularity of individual optical unit, it by no means happens that an unexposed region exists on the image carrier.

Note that here, "overlap" means that an end part of the first row projective light image and an end part of the second row projective light image in a longitudinal direction thereof have same coordinates in the case where a coordinate axis is provided in a direction orthogonal to the moving direction of the image carrier surface. Regarding coordinates in the case where a coordinate axis is provided in the moving direction of the image carrier surface, the first and second row project images may have same coordinates, or may have different coordinates.

With the second arrangement, in the region where the end parts of the first and second element row images overlap each other, one pixel is composed by two projective light image projected by two GLV elements which respectively belonging to the first and second element row units, that is, one projective light image constituting one row projective light image and the other constituting to the other row projective light image which both have a same coordinate with respect to an axis in a direction orthogonal to the moving direction of the image carrier surface. Therefore, since the pixels and the GLV elements do not correspond at a one-to-one ratio, it is impossible to control the element rows as if an image would be formed by a single element row.

To solve this problem, it is preferable that the image forming apparatus of the second arrangement further comprises an exposure control unit for, among the GLV elements projecting the end parts of the first and second row projective light images which overlap each other, allowing turning on of at least a part of the GLV elements projecting the end part of the first row projective light image which overlap the end part of the second row projective light image, and forbidding turning on of the second GLV elements whose projective light images overlap projective light images projected by the GLV elements of the first element row unit which are allowed to be turned on.

With this arrangement, in each pair of GLV elements corresponding to each pixel in the overlap region, the turning on of one element is allowed while the turning on of the other element is forbidden by the exposure control unit during image formation. Therefore, in the overlap region, the correspondence at a one-to-one ratio can be achieved between the pixels and the GLV elements. As a result, a plurality of element rows can be controlled as if an image would be formed by the necessary number of GLV elements lined in a single element row.

In the case where a single row of the GLV elements is divided into a plurality of rows, it is necessary to provide the element rows so that a pixel formed by a GLV element at the end of one element row comes just beside a pixel formed by a GLV element at the end of another element row, so as to sequentially provide the row projective light images formed by the element rows. To do so, position adjustment in a micron order is necessary, but such adjustment is impossible by the mechanical adjustment method, while it takes a lot of time to carry out such adjustment.

In contrast, by using the above-described exposure control unit, a plurality of element rows can be controlled as if they would be a single row of the necessary number of elements. Furthermore, it can be avoided that the overlap region has a light quantity greater than that in the other region.

Incidentally, regarding the second arrangement, it is necessary to identify which two GLV elements respectively belonging to two different element rows correspond to each pixel, and decide which GLV elements are used among those in the overlap region, so as to make the exposure control unit to control the turning on/off of the elements.

In light of the above requirement, it is preferable that the image forming apparatus of the second arrangement further comprises a projected light detecting unit for detecting the light projected by the first and second element row units only during an exposure condition setting operation wherein the GLV elements of the first and second element row units are sequentially turned on/off, the projected light detecting unit being provided in an overlap region, the overlap region indicating a region where the end parts of the first and second row projective light images overlap each other, wherein:

the projected light detecting unit includes a light receiving unit whose width in the longitudinal direction of the first row projective light image is smaller than a width of a projective light image projected by one GLV element in the longitudinal direction of the first row projective light image; and the exposure control unit sets exposure conditions of the optical modulator based on/off states of the respective GLV elements and an output of the projected light detecting unit during the exposure condition setting operation, and controls the turning-on/off of the respective GLV elements based on the exposure conditions during the image formation.

According to this arrangement, the projected light detecting unit used therein has a width in the longitudinal direction of the first row projective light image is smaller than a width of a projective light image projected by one GLV element in the longitudinal direction of the first row projective light image. Therefore, each light projected by each GLV element is individually detected by the projected light detecting unit.

Therefore, when the exposure control unit controls the turning on of the elements as described above, this arrangement facilitates the decision of exposure conditions, that is, which GLV elements among those corresponding to the pixels in the overlap region are used and which among those are not used.

The control methods of the GLV elements whose projective light images fall in the overlap region, with the use of the projected light detecting unit, will be described in detail in the description of the embodiments. As an example of the methods, in the image forming apparatus of the second arrangement, the exposure control unit is arranged so that:

when the GLV elements of the first element row unit are sequentially turned on from an end to the other end during the exposure condition setting operation, the exposure control unit stores as a first address a position of the GLV element which is turned on when projected light is detected by the projected light detecting unit for the first time;

when the second GLV elements are sequentially turned on in the same direction as the first GLV elements are turned on during the exposure condition setting operation, the exposure control unit stores as a second address a position of the second GLV element which is turned on when projected light is detected by the projected light detecting unit for the first time; and during the image formation, the exposure control unit forbids turning on of (1) each GLV element of the first element row unit provided on a side of a first end GLV element with respect to the GLV element having the first address, the first end GLV element indicating the GLV element corresponding to an end of the first row projective light image on a side of the overlap region, and (2) each GLV elements of the second element row unit provided on a side of the second end GLV element with respect to the GLV element having the second address, the second end GLV element indicating the GLV element corresponding to an end of the second row projective light image on a side of the overlap region, and allows turning on of either the GLV element having the first address or the GLV element having the second address while forbids turning on of the other.

As another example of the methods, in the image forming apparatus of the second arrangement, the exposure control unit is arranged so that:

when the first GLV elements are sequentially turned on from an end to the other end during the exposure condition setting operation, the exposure control unit stores as a first address a position of the first GLV element which is turned on when projected light is detected by the projected light detecting unit for the first time;

when the second GLV elements are sequentially turned on in the opposite direction to the direction in which the first GLV elements are turned on during the exposure condition setting operation, the exposure control unit holds a position of the second GLV element which is turned on when projected light is detected by the projected light detecting unit for the first time, checks whether or not projected light is detected by the projected light detecting unit when the next second GLV element is turned on, and stores as a second address a position of the second GLV element which is turned on when it is checked that projected light is detected as well by the projected light detecting unit, whereas the exposure control unit stores as the second address the position which has been held when it is not checked that the projected light is detected by the projected light detecting unit; and during the image formation, the exposure control unit forbids turning on of (1) each GLV element of the first element row unit on a side of a first end GLV element with respect to the GLV element having the first address, the first end GLV element indicating the GLV element corresponding to an end of the first row projective light image on a side of the overlap region, and (2) each GLV elements of the second element row unit on a side of a second end GLV element with respect to the GLV element having the second address, the second end GLV element indicating the GLV element corresponding to an end of the second row projective light image on a side of the overlap region, and allows turning on of either the GLV element having the first address or the GLV element having the second address while forbids turning on of the other.

With this arrangement, on deciding which GLV elements among those whose projective light images fall in the overlap region are used and which among those are not, no inconvenience happens even if the turning on of the GLV elements is started with an end of the element row on a side of the overlap region. Therefore, the period of time necessary for deciding which GLV elements are used and which are not can be reduced.

Incidentally, according to the second arrangement, light sources are provided so as to respectively correspond to the element row units. With such an arrangement, in comparison with the conventional arrangement, light sources are increased in accordance with the number of element row units into which the GLV elements are divided. This leads to such inconveniences as rises in material costs and an increase in consumption of power as well as causing the optical unit to become bulkier.

To avoid such inconveniences, it is preferable that the exposure unit of the image forming apparatus of the second arrangement includes a light dividing unit for dividing the light from the light source into two lights, and for projecting one of the two lights on the first element row unit while projecting the other light on the second element row unit.

According to this arrangement, light from a single light source is divided and used. Therefore, the exposure unit can be miniaturized, while the inconvenience of rises in the material costs can be avoided and the consumption of power can be reduced.

Furthermore, in the image forming apparatus of the second arrangement, it is preferable that:

the first element row unit includes a first element row and a second element row each having a plurality of the GLV elements, the first and second element rows being provided parallel to each other, the GLV elements constituting the first and second element rows being provided in a staggered manner such that each line extending from a center of each element of the second element row perpendicularly to a center line of the first element row runs between neighboring GLV elements of the first element row, and such that in each of the first and second element rows the GLV elements are provided at spaces, each space being smaller than a width of each GLV element in a longitudinal direction of the first element row; and the second element row unit includes a third element row and a fourth element row each having a plurality of the GLV elements, the third and fourth element rows being provided parallel to each other, the GLV elements constituting the third and fourth element rows being provided in a staggered manner such that each line extending from a center of each element of the fourth element row perpendicular to a center line of the third element row runs between neighboring GLV elements of the third element row, and such that in each of the third and fourth element rows the GLV elements are provided at spaces, each space being smaller than a width of each GLV element in a longitudinal direction of the third element row.

With this arrangement, the total length of the first and second element row units is set shorter than that in the case where the necessary number of GLV elements are lined in a single row. As a result, the necessary number of GLV elements can be provided so that the total length of the element rows is as short as possible. This enables the miniaturization of the optical modulator, and the improvement of the yield of the optical modulators.

Furthermore, insufficiency of light quantity in the peripheral parts of the GLV elements in the first and third element row units can be respectively compensated by the GLV elements in the second and fourth element row units, which overlap the peripheral parts of the GLV elements of the first and third element rows. As a result, the deterioration of the image quality caused by the peripheral parts where the light quantity is insufficient is suppressed, thereby causing the quality of printed pictures to be enhanced.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) is a perspective view of the optical unit, while FIG. 1(*b*) is a schematic plan view of the optical unit.

FIG. 5(*a*) is a cross-sectional view along the xz plane, while FIG. 5(*b*) is a cross-sectional view along the yz plane.

FIG. 6(*a*) is a cross-sectional view along the xz plane, while FIG. 6(*b*) is a cross-sectional view along the yz plane.

FIG. 9(*a*) is a view illustrating a linear image formed by a first GLV element row in the exposed region on the surface of the photosensitive drum, while FIG. 9(*b*) is a view illustrating a linear image formed by a second GLV element row in the exposed region on the surface of the photosensitive drum. FIG. 9(*c*) is a view illustrating a linear image of the GLV element row unit, which is composed of dot-like images in a staggered manner, wherein images formed by the first GLV element row unit and those formed by the second GLV element row unit are provided with a shift in a recording sheet transporting direction, the shift being equal to a distance between the first and second GLV element rows. FIG. 9(*d*) is a view illustrating a linear image formed under a control such that the image formed by the second GLV element row laps over the image formed by the first GLV element row.

FIG. 11(*a*) is a perspective view of the optical unit, while FIG. 11(*b*) is a plan view illustrating an arrangement of the GLV element rows of the optical unit.

FIG. 21(*a*) is a view illustrating the first step of the seventh method, FIG. 21(*b*) is a view illustrating the second step of the seventh method, FIG. 21(*c*) is a view illustrating the seventh step of the seventh method, FIG. 21(*d*) is a view illustrating the eighth step of the seventh method, FIG. 21(*e*) is a view illustrating the ninth step of the seventh method, FIG. 21(*f*) is a view illustrating the tenth step of the seventh method, FIG. 21(*g*) is a view illustrating the eleventh step of the seventh method, and FIG. 21(*h*) is a view illustrating the twelfth step of the seventh method.

DESCRIPTION OF THE PREFERRED EMBODIMENTS

[First Embodiment]

The following description will discuss a first embodiment of the present invention, with reference to FIGS. 1 through 10.

Figure 3:
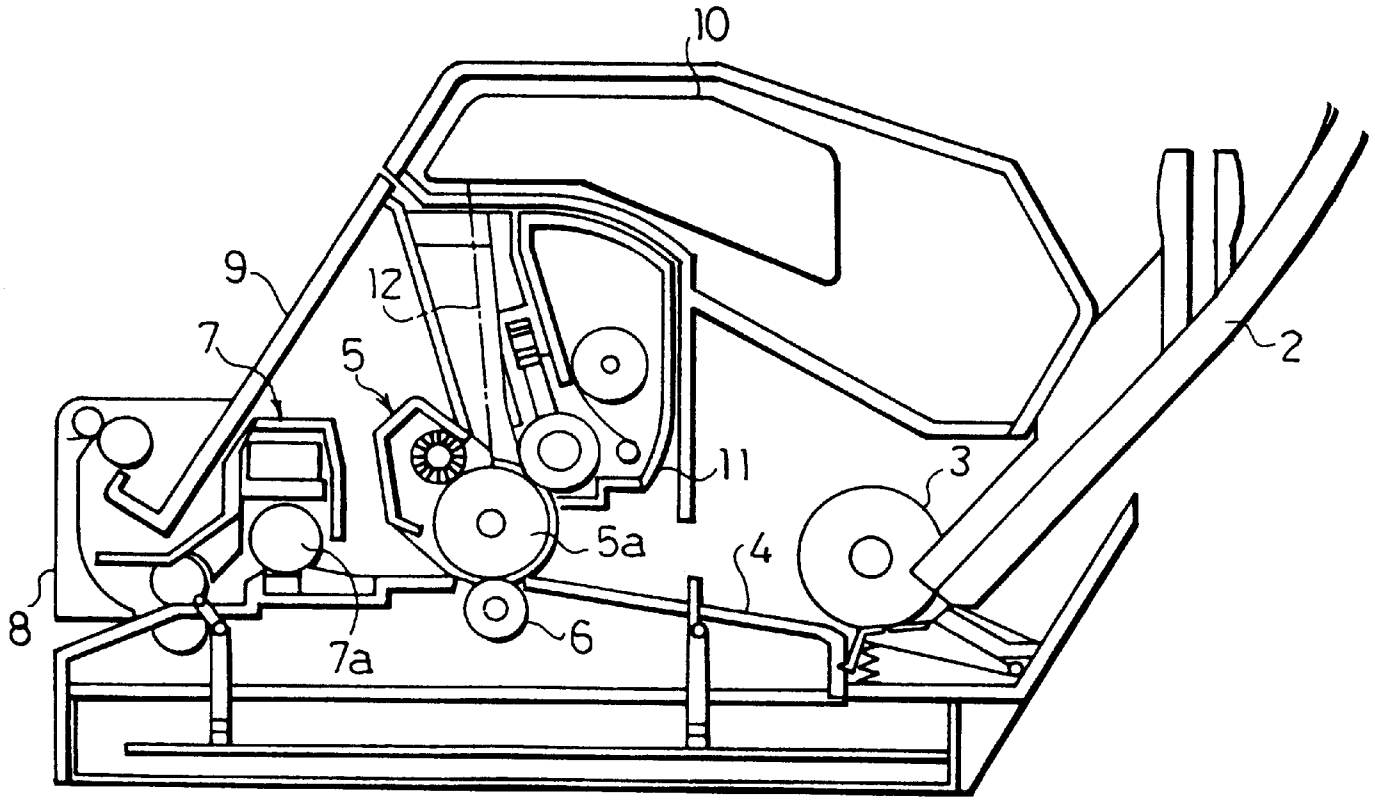
FIG. 3 is a front view illustrating the whole arrangement of the optical printer.

First of all, an all-out configuration of an optical printer as an image forming apparatus of the present invention is described, with reference to FIG. 3. The optical printer in accordance with the present embodiment has a paper feeding tray 2 for inserting a plurality of sheets of recording paper (recording material, hereinafter referred to as recording sheet), and a paper feeding roller 3 for sequentially feeding recording sheets into the inside of the optical printer during image formation. As illustrated in FIG. 3, the paper feeding tray 2 is provided on a side of the main body of the optical printer, and the paper feeding roller 3 is provided at the lower end of the paper feeding tray 2. On a downstream side of the paper feeding roller 3, a paper transporting path 4 is provided in a substantially horizontal direction, wherein a PS sensor for detecting an edge of a recording sheet is provided. On the downstream side of the paper feeding roller 3, there are also provided a drum cartridge 5 having a photosensitive drum (image carrier) 5*a* for forming an electrostatic latent image, and a transfer roller 6 (transfer means) for transferring a toner image on a surface of the photosensitive drum 5*a* onto a recording sheet.

Additionally, on a downstream side of the transfer roller 6, there is provided a fixing unit 7 having a fixing roller 7*a*, which fixes a toner image formed on the recording sheet. On a downstream side of the fixing unit 7, there is provided a U-turn guide 8 for discharging recording sheets on which images are formed into a discharge tray 9 provided on a front cover of the main body.

Above the drum cartridge 5, there is provided a developing unit (development means) 11 for supplying toner to the surface of the photosensitive drum 5*a* so that an electrostatic latent image thereon is developed. Above the developing unit 11, there is provided an optical unit (exposure means) 10 for projecting light onto the photosensitive drum 5*a*.

In the optical unit 10, a grating light valve (hereinafter referred to as GLV) optical modulator having a GLV element row is installed as an optical modulator, which will be described in detail later.

The following description will discuss image forming operations by the optical printer as arranged above.

In the optical printer thus arranged, a beam 12 from the optical unit 10 is projected on the surface of the photosensitive drum 5*a* which has been charged. The surface of the photosensitive drum 5*a* is exposed to light, thereby resulting in that an electrostatic latent image is formed on the surface of the photosensitive drum 5*a*.

The electrostatic latent image is developed when toner supplied from the developing unit 11 adheres thereto and forms a toner image which is visible. Sequentially, with the rotation of the photosensitive drum 5*a*, the toner image is transported in a direction toward a region where the photosensitive drum 5*a* and the transfer roller 6 come into contact with each other.

On the other hand, a recording sheet is fed from the paper feeding tray 2 by the paper feeding roller 3, and is transported along the paper transporting path 4 to a transfer region which is the region where the photosensitive drum 5*a* and the transfer roller 6 come into contact with each other.

Then, the toner image formed on the surface of the photosensitive drum 5*a* is transferred onto the recording sheet due to a potential difference, namely, a difference between charges of the toner image and the recording sheet surface.

The recording sheet is sent to the fixing unit 7 having the fixing roller 7*a*, and heat and pressure is applied to the recording sheet in the fixing unit 7. As a result, toner on the recording sheet is fused thereon due to the heat and pressure of the fixing roller 7*a*. Then, the recording sheet is sent out of the fixing unit 7, transported upward of the main body along the U-turn guide 8, and discharged onto the discharge tray 9 on the front cover covering the main body.

The optical unit 10 will be described below in detail, with reference to FIG. 1(*a*) and 1(*b*). Note that FIG. 1(*b*) is a view schematically illustrating the arrangement shown in FIG. 1(*a*), and a control unit 35 is not shown in FIG. 1(*b*).

The optical unit 10 includes a monochromatic light source unit (light source) 30, a collimating lens 31, the GLV optical modulator (optical modulator) 32, a slit 34, a projection lens 33, and the control unit 35.

The monochromatic light source unit 30 projects monochromatic light onto the collimating lens 31, and the collimating lens 31 converts the light projected by the monochromatic light source unit 30 into a parallel ray and projects the ray onto the GLV optical modulator 32.

The GLV optical modulator 32 has a GLV element row unit 38 wherein a plurality of the above-mentioned GLV elements 20 are provided in parallel rows in a width direction of the photosensitive drum 5*a*. The GLV elements 20 correspond to the pixel units on the photosensitive drum 5*a* in a one-to-one ratio. The GLV optical modulator 32 is arranged so as to modulate light projected from the collimating lens 31, in response to ON/OFF control of a voltage applied to the GLV element row unit 38.

The configuration of the GLV element row unit 38 will be described later in detail with reference to FIG. 2. Here, note that each element row is provided in the width direction of the photosensitive drum 5*a* (rotation axis direction), namely, in a direction orthogonal to a direction of transportation of the recording sheets (a moving direction of the surface 39 of the photosensitive drum 5*a*).

The slit 34 is provided between the GLV optical modulator 32 and the projection lens 33. Reflected light (diffracted light) from the GLV elements 20 in a control-ON state, namely, in the ON state, is passed through the slit, while reflected light from the GLV elements 20 in a control-OFF state, namely, in the OFF state, is not passed through the slit 34. The projection lens 33 projects the light which has been projected thereto by the GLV optical modulator 32, to the surface 39 of the photosensitive drum 5*a*.

The control unit 35 is a control center of the optical unit 10, being composed of a controller section and a memory section not shown in the figures. The control unit 35 is arranged so as to conduct the turning on/off of the monochromatic light source unit 30, ON/OFF control of the GLV element row unit 38 of the GLV optical modulator 32, or the like, thereby constituting exposure control means of the present invention.

Figure 4:
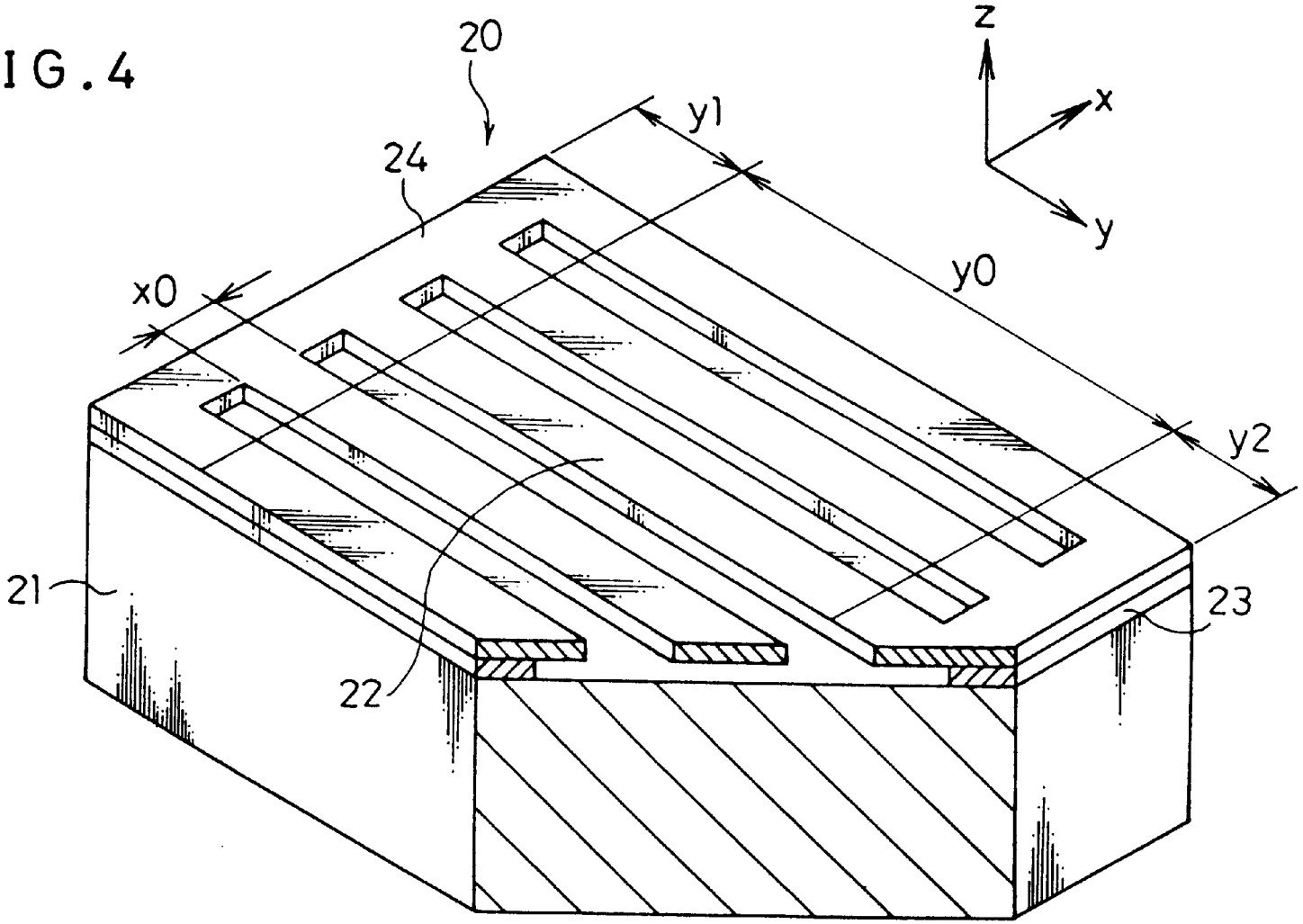
FIG. 4 is a perspective view illustrating one GLV element.
Figure 5A:
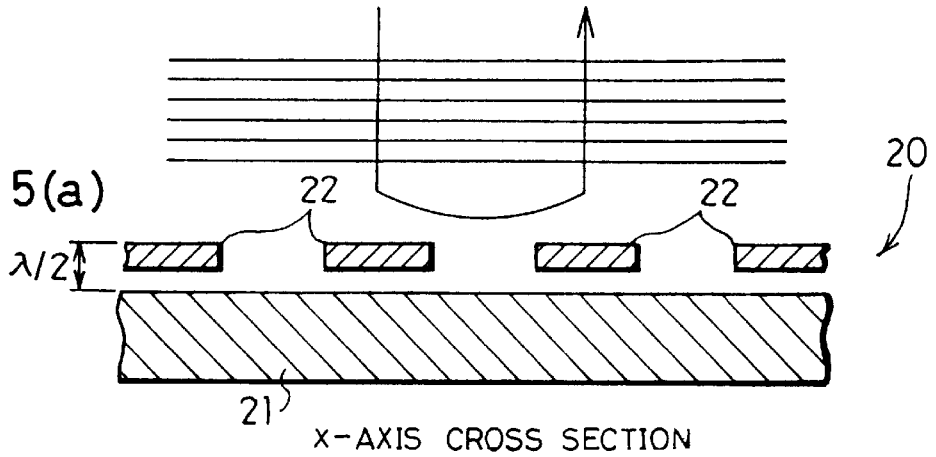
FIGS. 5(*a*) and 5(*b*) are views illustrating the GLV element in an OFF state.
Figure 5B:
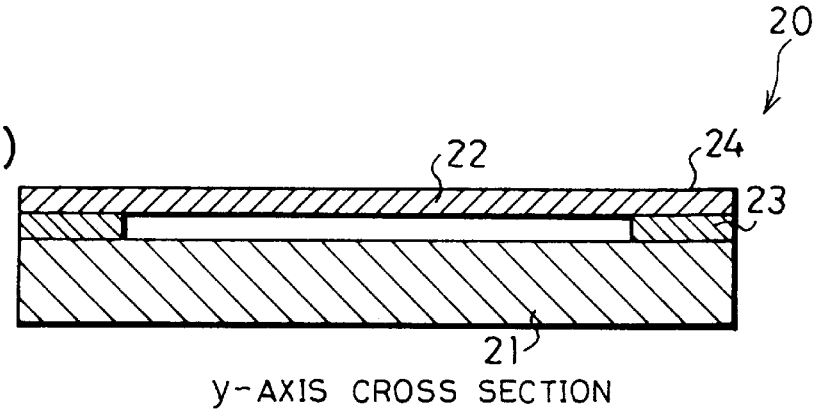
Figure 6A:
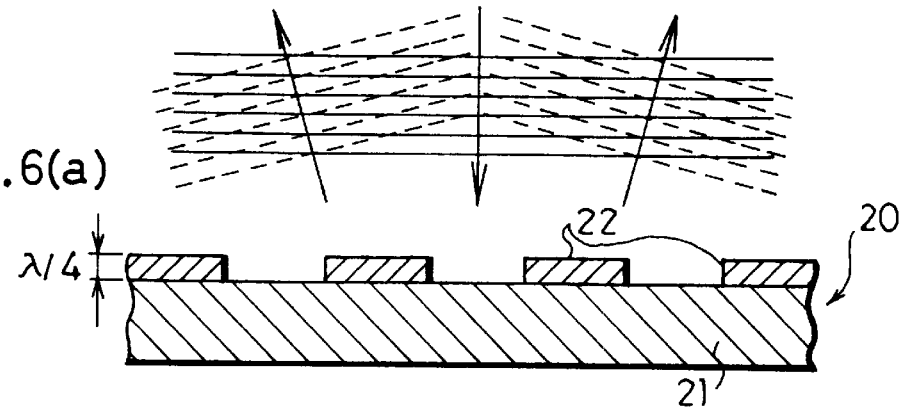
FIGS. 6(*a*) and 6(*b*) are views illustrating the GLV element in an ON state.
Figure 6B:
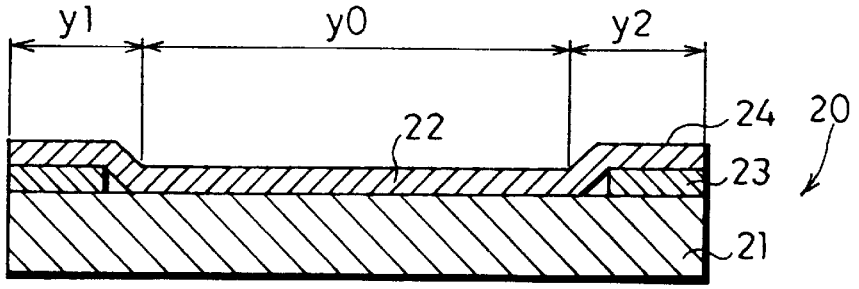

Here, before describing operations by the optical unit 10, the following description will discuss a configuration and operational principles of the GLV elements 20 constituting the GLV element row unit 38 in the GLV optical modulator 32, with reference to FIGS. 4 through 6. FIG. 4 is a perspective view of one GLV element, while FIGS. 5(*a*), 5(*b*), 6(*a*), and 6(*b*) illustrate operational principles of the GLV element.

The GLV element 20 has a configuration wherein microbridges 22 integrally formed with a frame 24 are provided over a substrate 21, with spacers 23 provided therebetween. With this arrangement, a gap having the same thickness as that of the spacers 23 is formed between an upper surface of the substrate 21 and the microbridges 22, while the substrate 21 and the microbridges 22 are provided in non-contact.

It is arranged that the thickness of the gap which is determined in accordance with the thickness of the spacers 23, and the thickness of the microbridges 22 are equal to each other, and the value is predetermined based on a wave length of light emitted from the light source. Namely, in the case where the light source emits light having a wave length of $\lambda$ nm, the thickness of the spacers 23 determining the gap and the microbridges 22 are respectively formed $\lambda/4$ nm in thickness. Such GLV elements 20 can be formed by the micro-semiconductor manufacturing technology (on details of the manufacturing method, see the U.S. Pat. No. 5,311,360, and other publications referred to above).

The operations of the GLV element 20 are controlled by ON/OFF operations of a voltage applied across the microbridges 22 and the substrate 21. FIG. 5(*a*) is an x-axis cross sectional view (cross section along an xz plane) of the GLV element 20 during the Control-OFF period, while FIG. 5(*b*) is a y-axis cross sectional view (cross section along a yz plane) of the same. FIG. 6(*a*) is an x-axis cross sectional view of the GLV element 20 during the Control-ON period, while FIG. 6(*b*) is a y-axis cross sectional view of the same.

During the Control-OFF period (voltage is off), the microbridges 22 maintain the position which is $\lambda/4$ nm apart from the substrate 21, as shown in FIGS. 5(*a*) and 5(*b*). When light is projected on the microbridges 22 in this state, a total optical path difference between respective lights reflected by the microbridges 22 and the substrate 21 becomes equal to the wave length of the incident light. Therefore, the microbridges 22 reflects light, serving as a diffraction grating plane mirror.

On the other hand, during the Control-ON period (voltage is on), the microbridges 22 are brought down by static electricity toward the substrate 21, as illustrated in FIGS. 6(*a*) and 6(*b*). When light is projected on the microbridges 22 in this state, a total optical path difference between respective lights reflected by the microbridges 22 and the substrate 21 becomes a half wave length ($\lambda/2$), and the respective reflected lights offset each other, thereby causing diffraction.

A length of the microbridges 22 in a longitudinal direction and a tensile stress of the same are determined as conditions for realizing above mechanical operations, taking the operation speed and a restitutive force of the same into consideration. As referred to in the above publications, it has already been found that so as to obtain a response time (switching time) of 20 ns, it is required that a length y0 of a effectual diffraction region of each microbridge 22 in the longitudinal direction is 20 $\mu$m, each of lengths y1 and y2 of ineffectual diffraction regions of the same is 2.5 $\mu$m. Therefore, each GLV element 20 has a width of 25 $\mu$m which includes the lengths y1 and y2 of the ineffectual diffraction regions.

A length of each microbridge 22 in a direction orthogonal to the longitudinal direction (hereinafter referred to as length x0 of the microbridge 22) is found from a wave length of light, an angle of incidence, and a diffraction angle, using an equation (1) below. Usually it is 0.5 to 2 $\mu$m.

Figure 1A:
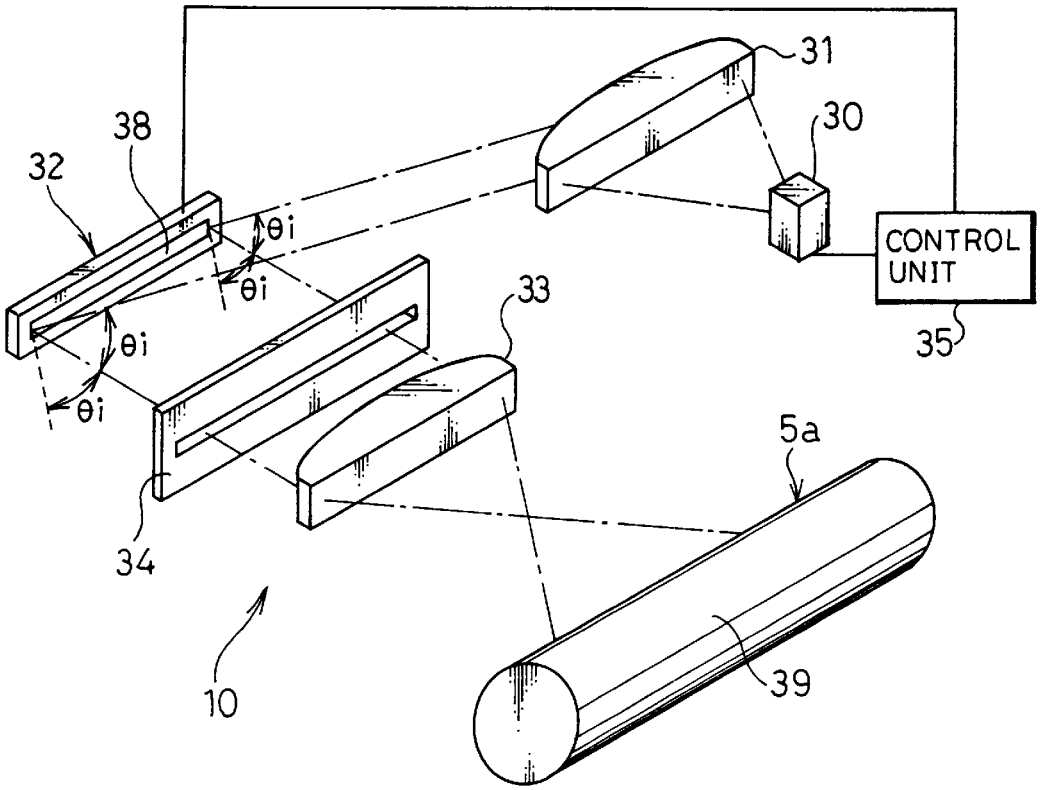
FIGS. 1(*a*) and 1(*b*) are views illustrating an arrangement of an optical unit of an optical printer in accordance with an embodiment of the present invention.
Figure 1B:
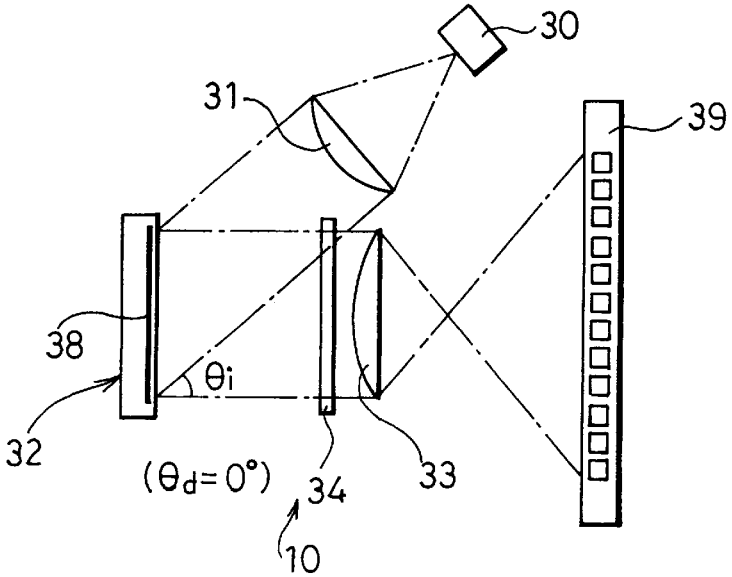

The following description will discuss a correlation of a wave length, an angle of incidence, a diffraction angle of the incident light to the GLV optical modulator 32, in the total arrangement of the apparatus including the optical system, with reference to FIGS. 1(*a*) and 1(*b*).

The light of the monochromatic light source unit 30 is collimated by the collimating lens 31, and the light thus collimated enters the GLV element row unit 38 at an angle of incidence $\theta_i$. The light which entered the GLV optical modulator 32 leaves the GLV element row unit 38 at a diffraction angle $\theta_d$ in the case where each GLV element 20 of the GLV element row unit 38 is in the Control-ON state. The light, then, passes the slit 34 and the projection lens 33, and reaches the photosensitive drum 5*a*. Here, with the wave length of the light given as $\lambda$ nm, the following relational expression is obtained:

$$\sin\theta_i - \sin\theta_d = \lambda/r \quad (1)$$

In the above expression, r (nm) is the length x0 of the microbridge 22, and is equal to the space between the microbridges 22.

In addition, in the present embodiment, as shown in FIGS. 1(*a*) and 1(*b*), the angle of incidence $\theta_i$ of the light from the collimating lens 31 to the GLV element row unit 38 is determined so that each GLV element constituting the GLV element row unit 38 has a diffraction angles $\theta_d$ of 0°.

On the other hand, in the case where each GLV element of the GLV element row unit 38 is in the Control-OFF state, the light which entered the GLV optical modulator 32 leaves there at the same angle as the angle of incidence $\theta_i$. Therefore, in this case, the light by no means passes the slit 34 nor reaches the photosensitive drum 5*a*.

Thus, by carrying out the ON/OFF control of the GLV elements 20 of the GLV element row unit 38 which correspond to the pixel units on the photosensitive drum 5*a* at a one-to-one ratio, it is possible modulate the light at a high speed, with the use of the GLV element row unit 38, in the place of the conventional rotary polygon scanner.

The operations of the optical unit 10 which is arranged as above will be discussed in the following description. In the optical unit 10 thus arranged, while the optical printer is in operation, the monochromatic light source unit 30 emits light in accordance with signals obtained by image processing by the controller section of the control unit 35. The light emitted by the monochromatic light source unit 30 is collimated by the collimating lens 31, and enters the GLV element row unit 38 of the GLV optical modulator 32 at an angle of incidence $\theta_i$.

Turning on/off of the respective GLV elements 20 of the GLV element row unit 38 is controlled in accordance with the signals obtained through image processing by the control unit 35, thereby causing the light to be selectively projected onto the projection lens 33 through the slit 34. More specifically, the light which have entered a GLV element 20 in the ON state in the GLV element row unit 38 leaves there at a diffraction angle $\theta_d$ (=0°), passes the slit 34, and enters the projection lens 33.

On the other hand, the light which have entered a GLV element 20 in the OFF state leaves there at an angle of reflection $\theta_i$ which is the same as the angle of incidence. Therefore, the light by no means passes the slit 34 nor enters the projection lens 33. Thus, the light projected to the projection lens 33 forms images on the surface 39 of the photosensitive drum 5*a*.

Incidentally, as described above, no sufficient consideration has been made on using the GLV elements in the above patent specification and other publications as a writing device in an optical printer. Therefore, in the case where the GLV elements in the above patent specification and other publications are applied, without modifications, to an optical printer as a writing device therein, there arise several inconveniences.

As one of the inconveniences, it is pointed out that in the case where a GLV optical modulator using the above-mentioned GLV elements is installed in an optical printer as a writing device thereof, it is too large in size as an optical modulator in an optical printer, and the yield of the optical modulators is low.

Besides, the above specification and other publications mention nothing on the arrangement of the GLV elements in an optical modulator of an optical printer composed of the GLV elements. In the case where a single row of GLV elements is provided so as to cover a recording width, the GLV element row becomes too long. Therefore, in the case where an optical modulator having a necessary number of GLV elements linearly aligned is applied to an optical printer in the place of the rotary polygon scanner, the optical modulator becomes bulky.

To be more specific with concrete numbers, in the case where the maximum recording width is a width (8.5 inches) of letter-size paper (8.5×11 inches), since 8.5×600=5100 pixels are necessary so as to obtain a resolution of 600 DPI in a width direction of the paper, the number of necessary GLV elements is also 5100. If GLV elements which is 25 μm wide each are linearly aligned, they become 128 mm long, which is too large. In addition, with today's semiconductor technology, it is very difficult to manufacture the GLV element rows 128 mm long in a good yield.

Furthermore, in the case where the GLV elements are linearly aligned, there arises another problem that the quality of printed images is lowered. Specifically, as illustrated in FIGS. 4 and 6 (*b*), the length of each GLV element 20 in the y direction is composed of the length y0 in the effectual diffraction region wherein regular diffraction effect can be obtained, and the lengths y1 and y2 in the ineffectual diffraction regions wherein regular diffraction effect cannot be obtained. And, as described above, a length y0 of the effectual diffraction region requires 20 μm, and the lengths y1 and y2 of the ineffectual diffraction regions require 2.5 μm each, so as to obtain a response at a speed of 20 ns.

Therefore, even with an arrangement wherein the GLV elements 20 are linearly aligned without a space between each other with the y direction of the GLV elements 20 conformed to the width direction of the photosensitive drum, a diffraction effect cannot be obtained from peripheral parts along the borders (hereinafter referred to peripheral parts), each part being 5 μm long (a sum of the lengths y1 and y2), when an all-out illuminating state is attempted by turning on all the GLV elements 20. Therefore, on the photosensitive drum, exposure is insufficient in portions which correspond to the peripheral parts, and this causes the portions to remain not developed. As a result, in the case where, for example, printing all in black is carried out, a recording sheet is caused to have line-like blanks running in the recording sheet transportation direction, the blanks corresponding to the peripheral parts of the GLV elements 20.

To solve this problem, an optical printer of the present embodiment has an arrangement wherein the GLV element row unit 38 has GLV elements 20 provided in two rows.

Figure 2:
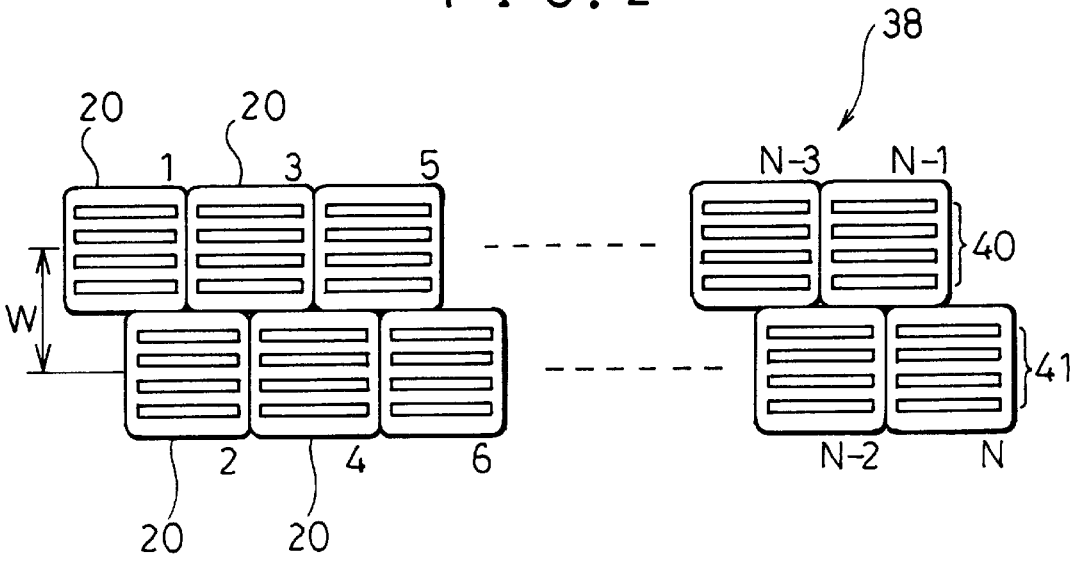
FIG. 2 is a plan view illustrating an arrangement of a grating light valve (GLV) element row unit of a GLV optical modulator provided in the optical unit.

The following description will discuss in detail the arrangement of the GLV element row unit 38 in the GLV optical modulator 32, which is characteristic of the optical printer of the present embodiment, with reference to FIG. 2. FIG. 2 is a plan view of the GLV element row unit 38, which is obtained when it is viewed from the projection lens 33 side.

The GLV element row unit 38 has a first GLV element row 40 (1, 3, . . . , N-3, N-1) and a second GLV element row 41 (2, 4, . . . , N-2, N), each having N/2 GLV elements in the case where the number of necessary GLV elements is N. In each row, N/2 GLV elements are linearly aligned without a gap between each other, and abut each other and are connected to each other, with the y direction in FIG. 4 (the longitudinal direction of the microbridge 22) conformed with a longitudinal direction of the row. Each longitudinal direction of the first and second GLV element rows 40 and 41 is conformed with a rotation axis direction of the photosensitive drum 5*a* (a direction orthogonal to a moving direction of the surface 39 of the photosensitive drum 5*a*).

The first and second GLV element rows 40 and 41 are provided parallel and abutting each other, with the second GLV element row 41 shifted with respect to the first GLV element row 40 by half a width of the GLV element 20 in the y direction thereof. As a result, the GLV elements 20 of the first and second GLV element rows 40 and 41 are provided in a staggered manner.

Therefore, each line extending from a center of each GLV element of the second GLV element row 41 perpendicularly to a center line of the first GLV element row 40 runs between neighboring GLV elements of the first GLV element row 40.

Note that each GLV element 20 of the GLV element row unit 38 is provided so that each upper surface of the microbridges 22 is provided on a same plane so that each reflection plane of the GLV elements 20 is provided on a same plane.

The number N of the GLV elements 20 necessary so as to form the GLV element row unit 38 can be found using the following equation (2):

$$N=AB/25.4 \quad (2)$$

wherein a width of a recording sheet in a direction orthogonal to the recording sheet transportation direction is given as A (mm), and a resolution is given as B (DPI).

Figure 7:
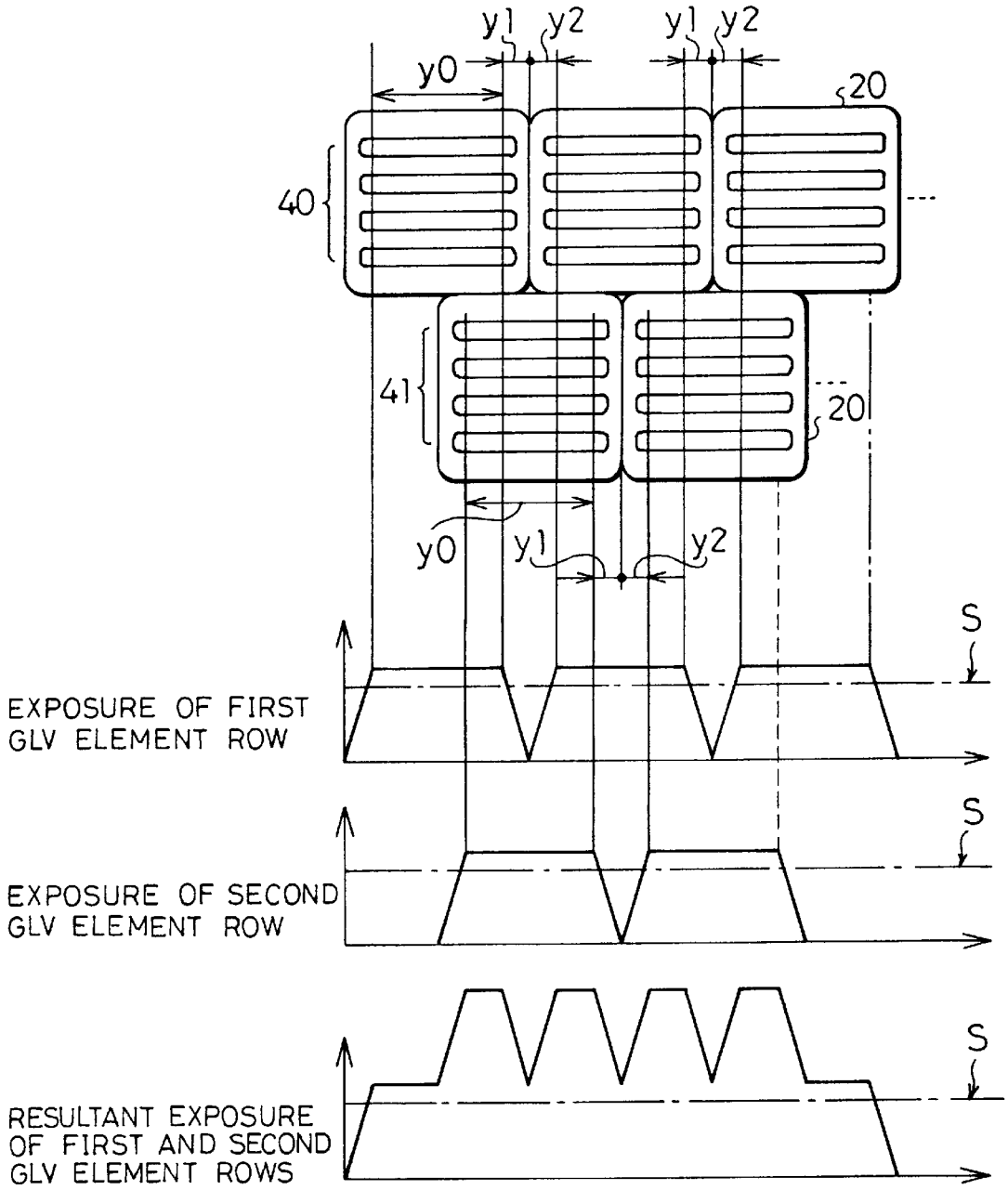
FIG. 7 is a view illustrating a correlation between positions of GLV elements in the GLV element row unit in a longitudinal direction and exposure of a surface of a photosensitive drum.

Here, FIG. 7 is referred to, which illustrates a correlation between the positions (coordinates) of the GLV elements 20 of the GLV element row unit 38 and the exposure of the surface 39 of the photosensitive drum 5*a*. A line denoted S in FIG. 7 represents a minimum exposure required for forming electrostatic latent images on the surface 39 of the photosensitive drum 5*a*. As is clear from FIG. 7, regarding the respective exposure by the first and second GLV element rows 40 and 41, there are regions on the surface 39 where exposure is insufficient, which correspond to the diffraction ineffectual regions each being y1+y2 long in the peripheral parts of the GLV elements 20. However, the resultant exposure of the first and second GLV element rows 40 and 41 exceeds the value shown by a line S in the figure, anywhere in the element row longitudinal direction.

Thus, so as to form the GLV element row unit 38 in the GLV optical modulator 32 of the optical printer in accordance with the present embodiment, the GLV elements 20 in the necessary number are divided into the first and second GLV element rows 40 and 41. Therefore, it can be arranged so that the GLV optical modulator 32 has a length of only about ½ of the sum of widths (in the longitudinal direction of the element rows) of the necessary number of the GLV elements 20. With this arrangement, the yield of the GLV optical modulator 32 can be improved, while miniaturization of the GLV optical modulator 32 is made possible.

Besides, in the GLV element row unit 38, the GLV elements 20 constituting the first and second GLV element rows 40 and 41 are provided without a space therebetween in the staggered manner. Therefore, the first GLV element row 40 and the second GLV element row 41 abut each other, and overlap each other in the moving direction of the photosensitive drum 5*a*. As a result, the effectual diffraction regions in the first and second element rows 40 and 41 are also provided in the staggered manner, and hence they are continuously provided.

Therefore, it is ensured that the insufficiency of the exposure in each peripheral part of the GLV elements 20 in the first GLV element row 40 is compensated with the exposure by each GLV element 20 in the second GLV element row 41 whose central part overlaps each peripheral part of the GLV elements 20 in the first GLV element row 40. Thus, the deterioration of the image quality due to the insufficient exposure at the peripheral parts of the GLV elements is avoidable, thereby enabling the improvement of the image quality of printed pictures.

Incidentally, in the case where, as in the GLV element row unit 38, the first and second GLV element rows 40 and 41 are provided with a shift in a direction orthogonal to the longitudinal direction of the GLV element rows, namely, in the moving direction of the photosensitive drum 5*a*, a position of exposure by the GLV elements 20 in the first GLV element row 40 shifts from a position of exposure by the GLV elements 20 in the second GLV element row 41 in the moving direction of the photosensitive drum 5*a*, and this shift between the respective exposure positions of the two rows corresponds to the shift between the positions of the rows in the direction orthogonal to the longitudinal direction of the GLV element rows.

Figure 8:
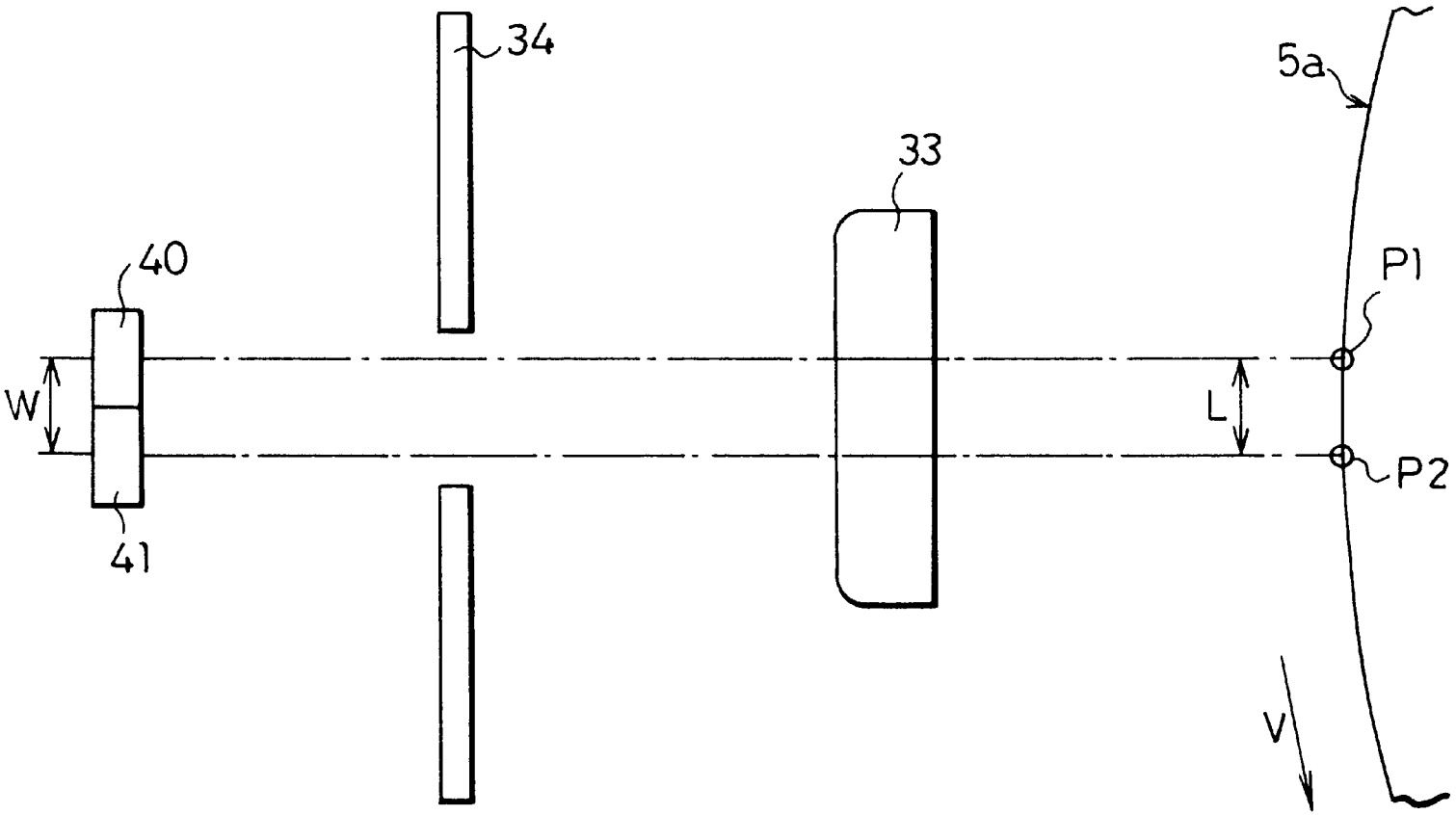
FIG. 8 is an enlarged view illustrating an optical path from the GLV element row to an exposed region on the surface of the photosensitive drum.

FIG. 8 is an enlarged view illustrating an optical path from the GLV element row unit 38 of the GLV optical modulator 32 to exposed regions on the surface 39 of the photosensitive drum 5*a*. In FIG. 8, P1 is a position of a region exposed by the first GLV element row 40, while P2 is a position of a region exposed by the second GLV element row 41. The exposure position P2 on a circumferencial surface of the photosensitive drum 5*a* is provided at a distance L from the exposure position P1, the distance L corresponding to a shift W between the first and second GLV element rows 40 and 41.

Figures 9A, 9B, 9C, 9D:
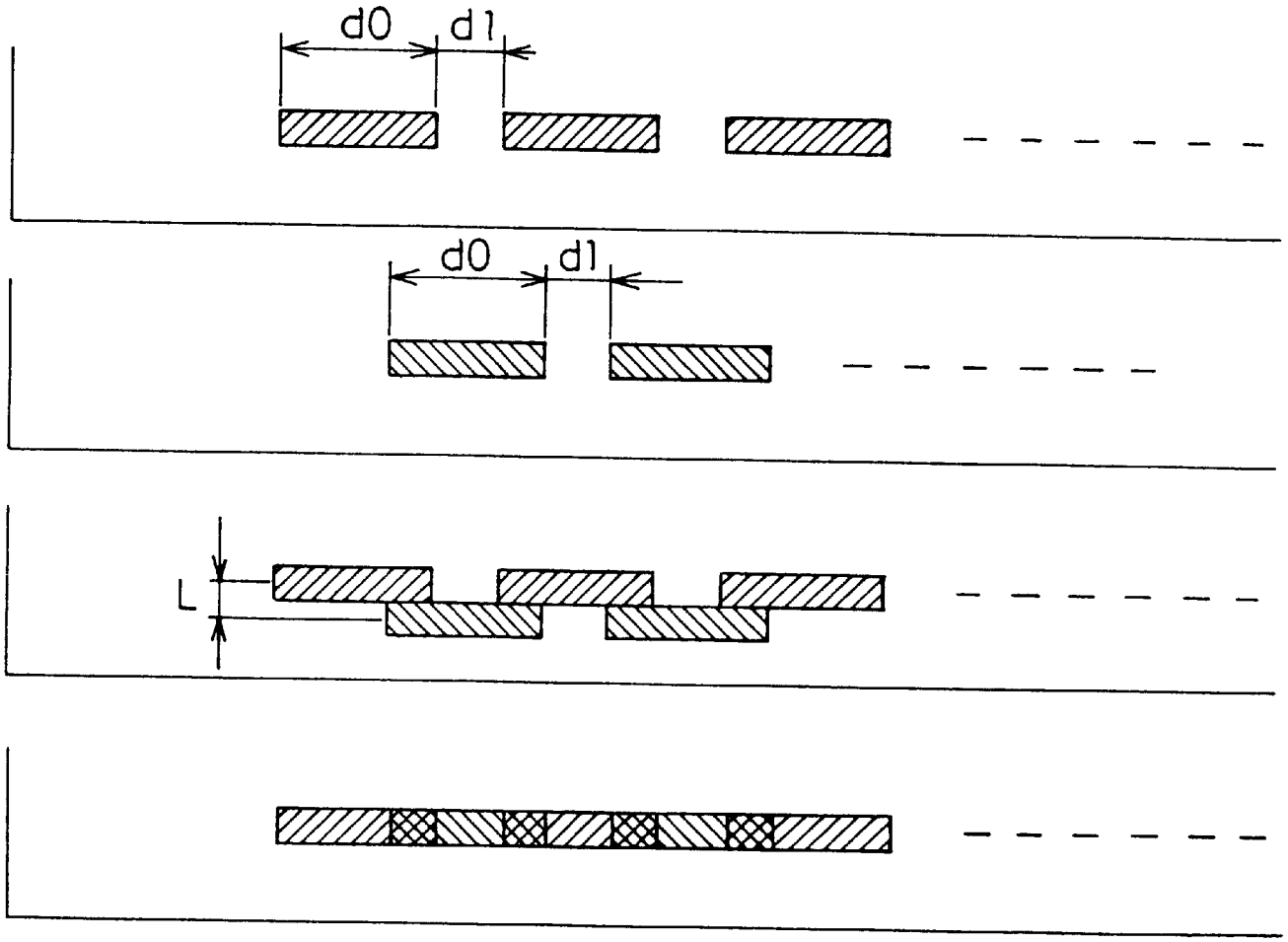
FIGS. 9(*a*) through 9(*d*) are views illustrating linear images formed in the exposed region on the surface of the photosensitive drum by the projection by the GLV element row unit.

FIG. 9(*a*) illustrates an image formed by the first GLV element row 40 at the exposure position P1 on the surface 39 of the photosensitive drum 5*a*. FIG. 9(*b*) illustrates an image formed by the second GLV element row 41 at the exposure position P2 on the surface 39 of the photosensitive drum 5*a*. In FIGS. 9(*a*) and 9(*b*), a width d0 is a width of a region exposed by an effectual diffraction region of each GLV element 20, while a width d1 is a width of an unexposed region due to an ineffectual diffraction region corresponding to each peripheral part of the GLV elements 20.

As is clear from FIGS. 9(*a*) and 9(*b*), each of the images formed by the first and second GLV element rows 40 and 41 is a dot line. Therefore, in the case where the first and second GLV element rows 40 and 41 are simultaneously turned on, an image appearing a line is formed, which is composed of dots provided in a staggered manner with a shift of the distance L in the recording sheet transportation direction, as illustrated in FIG. 9(*c*).

Such a line-like image composed of the dots in the staggered manner thus has a deviation from a strictly straight line. But in the case with an image forming apparatus having a low resolution, such a deviation falls in an error range and does not cause an outstanding reverse affect, thereby not necessitating turning-on timing control by the control unit 35 as described below. However, in the case with an image forming apparatus having a high resolution, the linearity of a line-like image is strictly demanded.

To meet with this demand, the control unit 35 as exposure control means conducts turning-on timing control so that each GLV element 20 of the second GLV element row 41 which are provided on the downstream side of the first GLV element row 41 is turned on with a delay ΔT after the turning-on of each GLV element 20 of the first GLV element row 40, ΔT satisfying:

$$\Delta T = L/V$$

where V is a peripheral velocity (moving velocity) of the photosensitive drum 5*a* and L is a distance between the exposure positions P1 and P2 on the circumference of the photosensitive drum 5*a*.

By thus conducting the turning-on timing control, the photosensitive drum 5*a* rotates during the period of the delay ΔT=L/V after turning on the first GLV element row 40, thereby causing the exposure position P2 to coincide with the exposure position P1. As a result, an image having good linearity as illustrated in FIG. 9(*d*) can be obtained.

In the above arrangement, the GLV elements 20 in the first and second GLV element rows 40 and 41 are provided with no gap between each other. Therefore, in the above arrangement, each GLV element 20 in the first GLV element row 40 abuts each GLV element 20 in the second GLV element row 41, and each of overlap parts of the edges of the GLV elements 20 has a length equal to 50 percent of the element width (width of each GLV element 20 in the longitudinal direction of the first GLV element row 40).

On the other hand, each element of the first and second GLV element rows 40 and 41 may be provided at spaces each of which is smaller than the width of each element in the longitudinal direction of the first GLV element row 40.

More specifically, one GLV element 20 in the first GLV element row 40 and another in the second GLV element row 41 abut each other, the overlap part of each edge having a length of less than 50 percent of the element width.

In the case of the GLV element 20 as described above, by providing the GLV elements 20 so that they have overlapping edge parts each of which has a length of not less than 20 percent and less than 50 percent of the element width, insufficiency of light quantity in the peripheral parts of the first GLV element row 40 can be surely compensated by the GLV elements 20 of the second GLV element row 41 whose central parts are respectively provided just beside the peripheral parts of the GLV elements of the first GLV element row 40. The ratio of the overlapping edge part length to the element width may be adjusted within the above range, by adjusting the spaces between the elements in each of the first and second GLV element rows 40 and 41.

In other words, so as to eliminate the insufficiency of the light quantity in the peripheral parts, the GLV elements 20 of the first and second GLV element rows 40 and 41 should be provided so that the effectual diffraction regions in each GLV element 20 are continuously provided.

Figure 10:
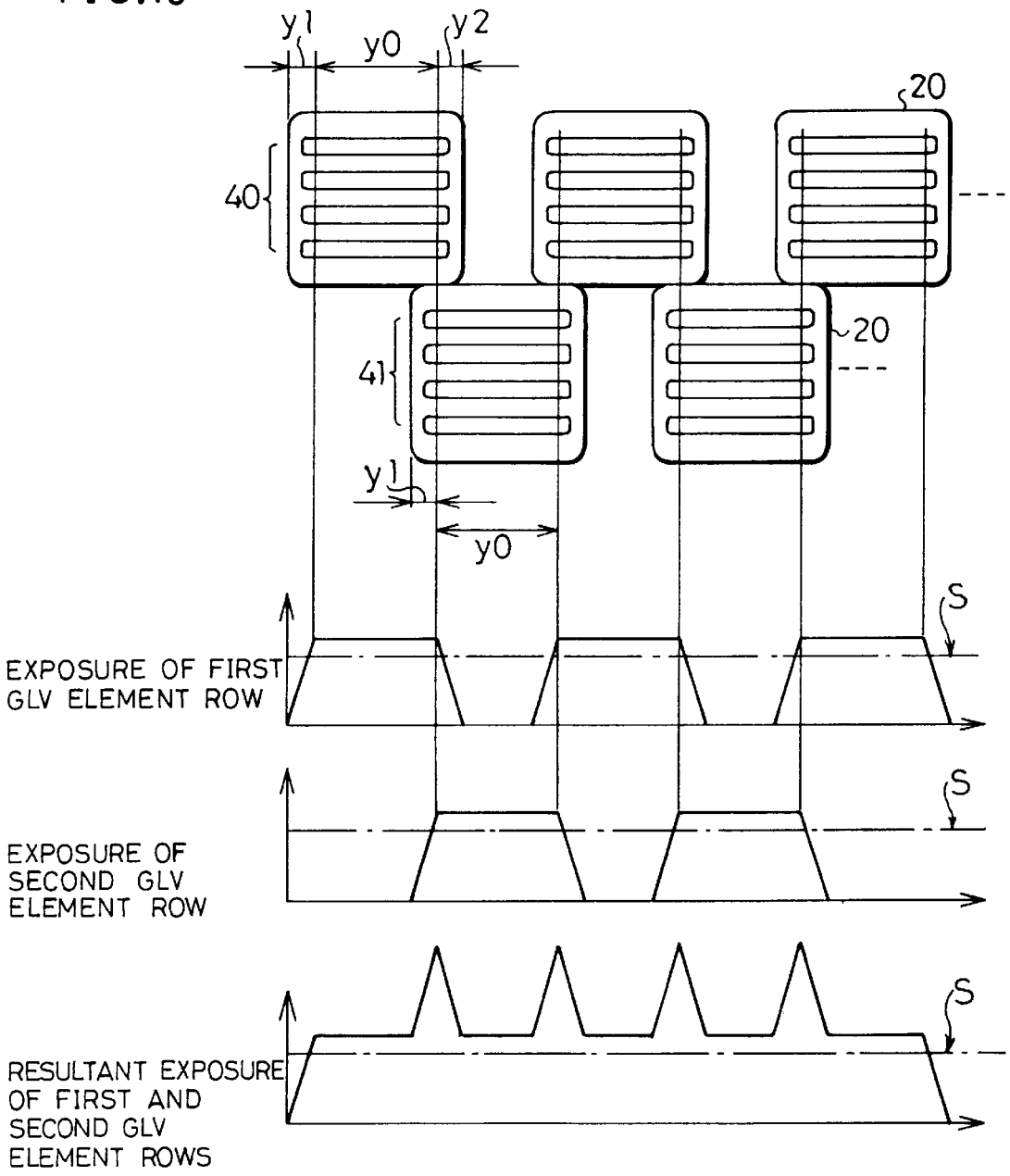
FIG. 10 is a view illustrating an arrangement of the GLV element row unit of the optical unit of the optical printer in accordance with another embodiment of the present invention, and a correlation between the positions of the GLV elements in the longitudinal direction of the element row and the exposure of the surface of the photosensitive drum.

Therefore, as an arrangement wherein the GLV elements abut each other with their edges overlapping each other at a minimum length, the following arrangement illustrated in FIG. 10 may be proposed. In the arrangement, one GLV element in the first GLV element row 40 and another in the second GLV element row 41 abut each other with their edges in the element row longitudinal direction partially overlapping each other, namely, so that only the parts of the edges in their ineffectual diffraction regions (length: y1+y2) overlap each other while the parts in the effectual diffraction regions of the same do not overlap each other.

In the above arrangement, the ratio of a length of each overlap part of each edge to the element width is given as (y1+y2)/(y1+y0+y2), and in the case of the GLV element 20 of the present embodiment y1=y2=2.5 μm and y0=20 μm. Therefore, in the arrangement shown in FIG. 10, each of the overlap parts of the edges of the GLV elements 20 accounts for 20 percent of the element width.

[Second Embodiment]

The following description will discuss another embodiment of the present invention, with reference to FIGS. 11 through 22. The members having the same structure (function) as those in the above-mentioned embodiment will be designated by the same reference numerals and their description will be omitted.

Figure 12:
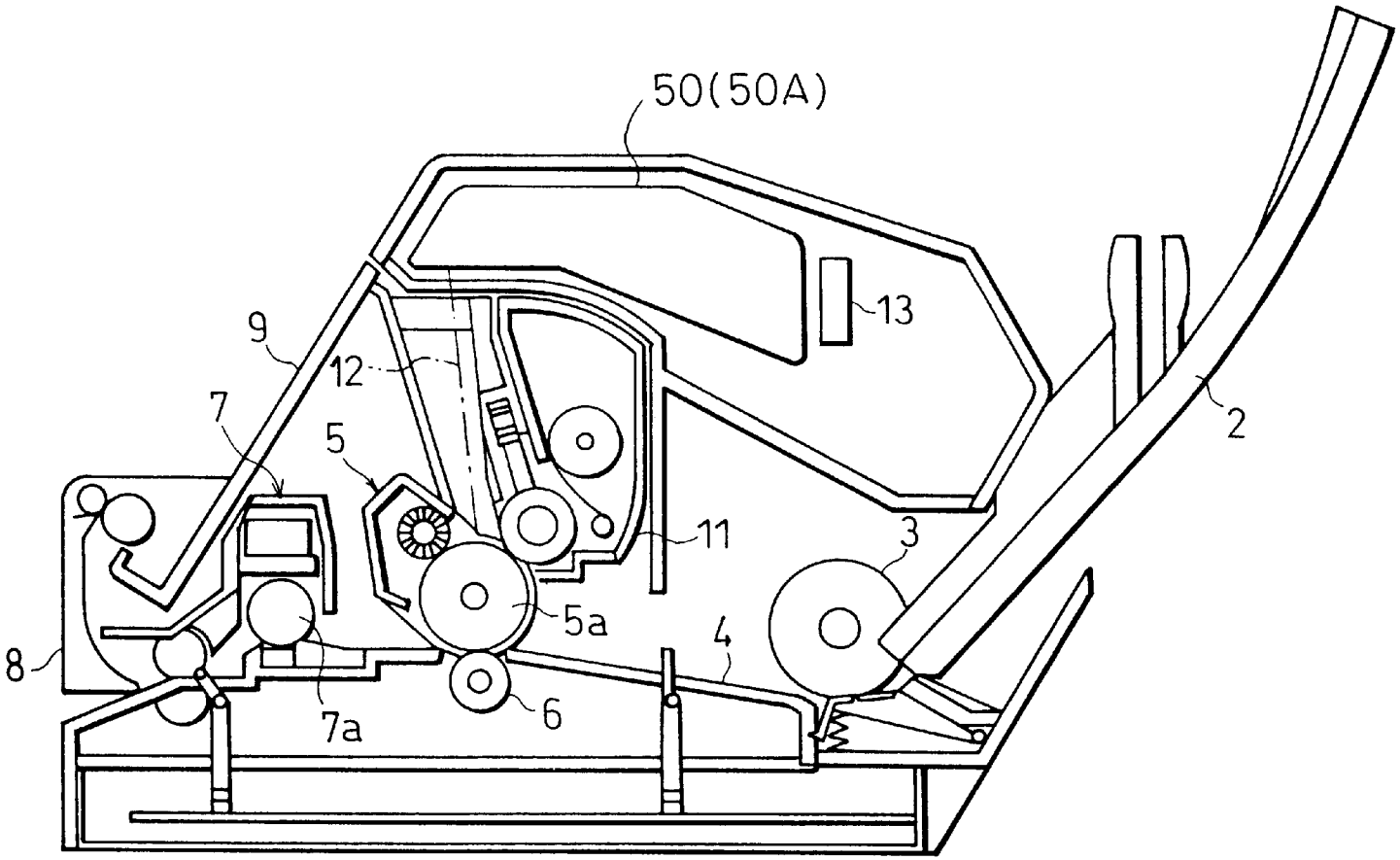
FIG. 12 is a front view illustrating an arrangement of the optical printer.

As illustrated in FIG. 12, an optical printer in accordance with the present embodiment has the same configuration as the optical printer in accordance with the first embodiment, except that an optical unit (exposure means) 50 and a control unit (exposure control means) 13 are provided above the developing unit 11, instead of the optical unit 10 of the optical printer of the first embodiment.

In the optical unit 50, a monochromatic light source unit, a collimating lens, a GLV optical modulator, a projection lens, and others are installed, so that light is projected on a surface of a photosensitive drum 5*a*. The arrangement thereof will be discussed later in detail.

In the optical printer as arranged above, when a signal which orders printing is supplied from an external device such as a personal computer to the control unit 13 of the optical printer, an operation of the optical printer starts in response to the signal, thereby causing a beam 12 in accordance with image data is projected from the optical unit 50 onto the surface of the photosensitive drum 5*a* which has been previously charged. With the projection of the beam 12, the surface of the photosensitive drum 5*a* is exposed, thereby causing an electrostatic latent image to be formed on the surface of the photosensitive drum 5*a*. The electrostatic latent image is developed when toner supplied from the developing unit 11 adheres to the photosensitive drum 5*a*, thereby becoming a visual image. The visual image is moved, with the rotation of the photosensitive drum 5*a*, to a region where the photosensitive drum 5*a* and the transfer roller 6 come into contact with each other.

At the same time, a recording sheet is supplied from the paper feeding tray 2 by the paper feeding roller 3, and the recording sheet is transported along the paper transporting path 4 to the region where the photosensitive drum 5*a* and the transfer roller 6 come into contact with each other, which is hereinafter referred to as transfer region. When the recording sheet passes through the transfer region, the toner image having been formed on the surface of the photosensitive drum 5*a* is transformed onto the recording sheet due to a potential difference between the charge of the toner image and the charge of the surface of the recording sheet.

Thereafter, the recording sheet is transported to the fixing unit 7 having the fixing roller 7*a*, and due to the heat and pressure of the fixing roller 7*a*, heat and pressure is applied thereto by the fixing unit 7 so that the toner on the recording sheet is fused thereon. The recording sheet sent out of the fixing unit 7 is guided along the U-turn guide 8 to the upper part of the main body, and is discharged to the discharge tray 9 on the front cover which covers the main body.

Figure 11A:
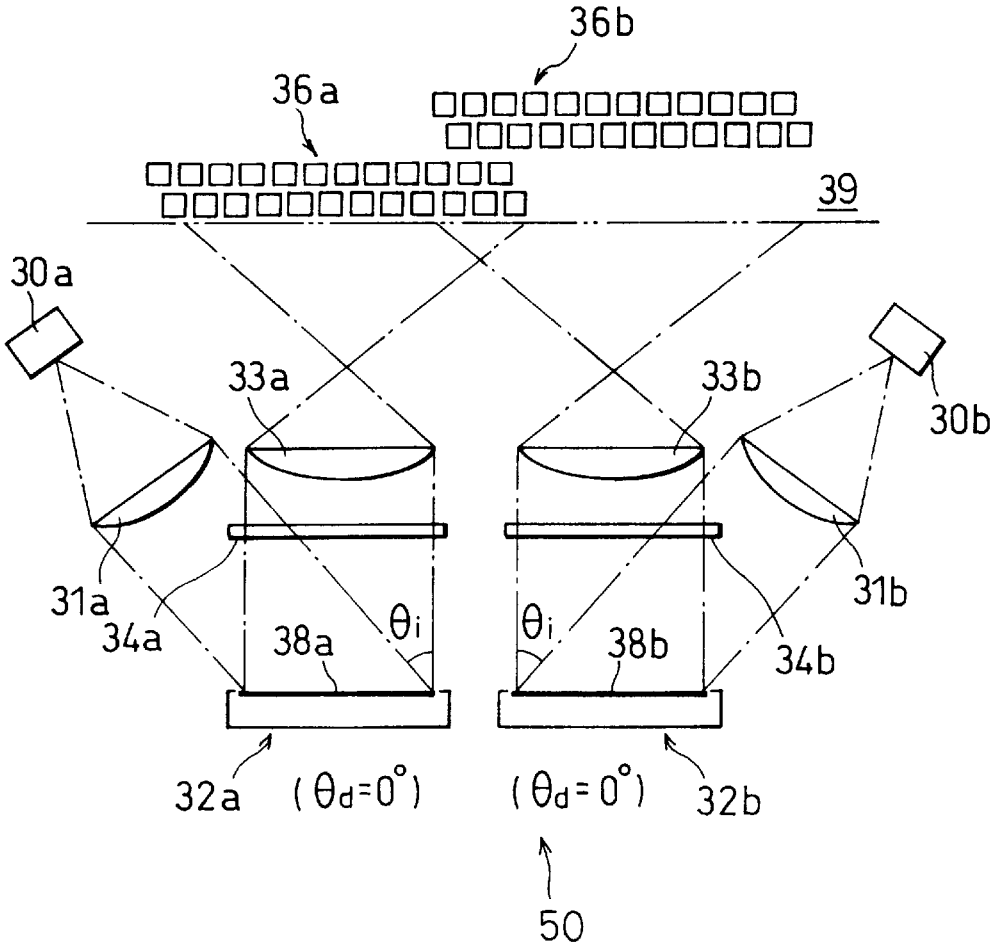
FIGS. 11(*a*) and 11(*b*) are views illustrating an arrangement of the optical unit of the optical printer in accordance with still another embodiment of the present invention.
Figure 11B:
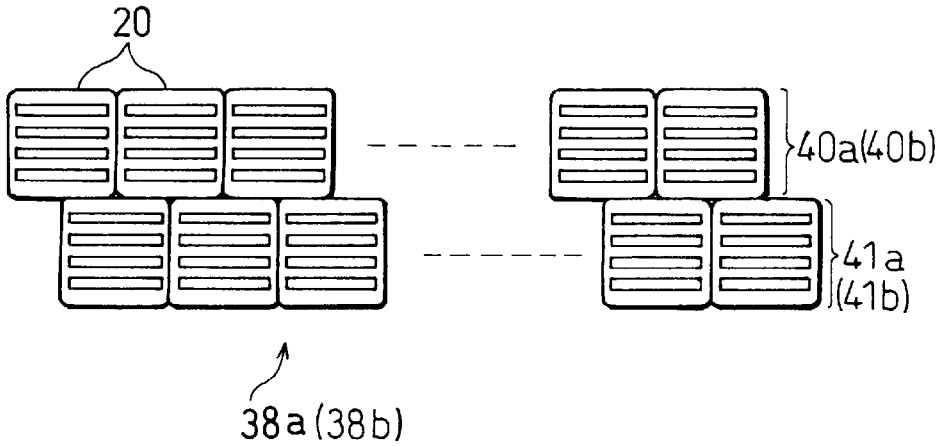

Then, the optical unit 50 will be described in detail below with reference to FIGS. 11(*a*) and 11(*b*). FIG. 11(*a*) is a schematic view illustrating an arrangement of the optical unit 50 (a schematic view like FIG. 1(*b*)). In FIG. 11(*a*), an arrangement wherein the GLV element rows are divided into two is illustrated as an example.

The optical unit 50 has two writing units. In one writing unit, there are provided a monochromatic light source unit (light source) 30*a* for emitting monochromatic light, a collimating lens 31*a* for collimating the light emitted by the monochromatic light source unit 30*a*, a GLV optical modulator 32*a* for modulating the light from the collimating lens 31*a* and directing the light thus modulated through a slit 34*a* to a projection lens 33*a*, and the projection lens 33*a* for projecting the light thus projected thereto to the surface 39 of the photosensitive drum 5*a*. Likewise, in the other writing unit, there are provided a monochromatic light source unit (light source) 30*b*, a collimating lens 31*b*, a slit 34*b*, a GLV optical modulator 32*b*, and a projection lens 33*b*. Note that in FIG. 11(*a*) the monochromatic light source units 30*a* and 30*b* and the collimating lenses 31*a* and 31*b* are illustrated on the left and right sides respectively, so as to be plainly shown.

In the GLV optical modulator 32*a*, as shown in FIG. 11(*b*), there is provided a GLV element row unit (first element row unit) 38*a*. The GLV element row unit 38*a* has the same configuration as the GLV element row unit 38 shown in FIG. 2 referred to in conjunction with the first embodiment, and hence the same includes a first GLV element row (first element row) 40*a* and a second GLV element row (second element row) 41*a*, each composed of a plurality of GLV elements 20. The GLV elements 20 constituting the first and second GLV element rows are provided respectively in a staggered manner. Furthermore, as is the case with the GLV optical modulator 32*a*, there is provided a GLV element row unit (second element row unit) 38*b*, which, as the GLV element row 38*a*, has a staggered manner and includes a first GLV element row (third element row) 40*b* and a second GLV element row (fourth element row) 41*b*.

Note that the GLV element 20 has the same configuration as that in the first embodiment.

Each of the GLV element row units 38*a* and 38*b* is provided so that the element longitudinal direction conforms to the width direction of the photosensitive drum 5*a*. Besides, each GLV element row unit is designed so as to have an angle of incidence $\theta_i$ such that the GLV elements 20 have a diffraction angle $\theta_d$ of 0° in an ON state (control-ON state).

Figure 13:
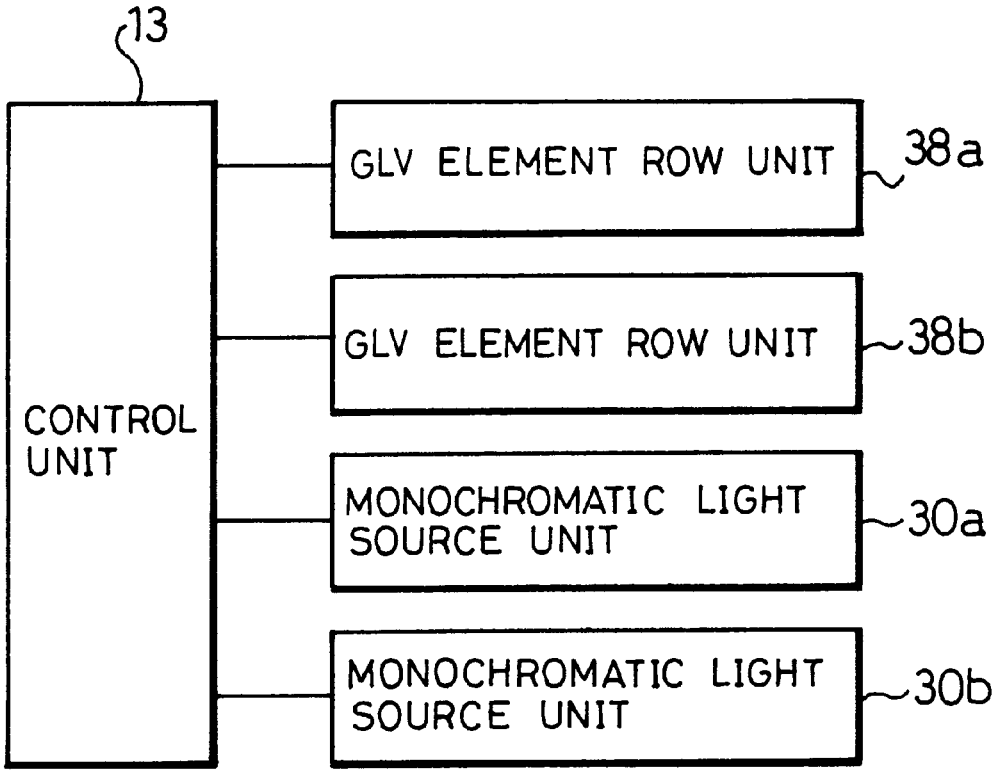
FIG. 13 is a block diagram illustrating a control system of the optical unit of the optical printer.

Furthermore, as illustrated in FIGS. 12 and 13, the optical unit 50 is connected to the control unit 13 having a memory (not shown). The control unit 13 controls the turning on/off of the monochromatic light source units 30*a* and 30*b*, and the turning on/off of each GLV element 20 constituting each of the GLV element row units 38*a* and 38*b*.

When the optical printer is in operation, the monochromatic light source units 30*a* and 30*b* illuminate in accordance with the control of the control unit 13. The respective lights emitted from the monochromatic light source units 30*a* and 30*b* are collimated by the collimating lenses 31*a* and 31*b*, and are respectively projected diagonally from above to the front of the GLV element row units 38*a* and 38*b*.

With the above described operation, the GLV optical modulators 32*a* and 32*b* turn on/off each GLV element 20 in accordance with image signals processed at the control unit 13, and respective lights from GLV elements 20 in the ON state pass through the slits 34*a* and 34*b* and are directed to the projection lenses 33*a* and 33*b*, respectively. The lights thus directed to the projection lenses 33*a* and 33*b* are projected on the surface 39 of the photosensitive drum 5*a* and form individual pixels.

With this, as illustrated in FIG. 11(*a*), a light projected by the GLV element row unit 38*a* projects a projective light image (first row projective light image) 36*a*, while a light projected by the GLV element row unit 38*b* projects a projective light image (second row projective light image) 36*b*. In addition, each of square-shape images constituting the projective light images 36*a* and 36*b* is each projective light image (element projective light image) projected by each GLV element 20, namely, each pixel.

Incidentally, so that the projective light images 36*a* and 36*b* respectively projected by the two GLV element row units 38*a* and 38*b* are made to appear a single projective light image as if having been projected by a single GLV element row, it is necessary that the pixel at the end of the GLV element row unit 38*b* come just beside the pixel at the end of the GLV element row unit 38*a* so that the projective light images 36*a* and 36*b* are continuously provided. However, in order to do so, fine adjustment in a micron order is required, and such adjustment is difficult by the mechanical adjustment method, as well as it takes a lot of time to complete the adjustment.

To solve this problem, the optical unit 50 of the optical printer of the present embodiment is designed so that respective end parts of the projective light images 36*a* and 36*b* in the longitudinal direction thereof overlap each other in the moving direction of the surface 39 of the photosensitive drum 5*a*, in the vicinity of the center in the width direction of the surface 39 of the photosensitive drum 5*a* (the region wherein the end parts of the projective light images overlap each other are hereinafter referred to as overlap region, and the end parts overlapping each other are hereinafter referred to as overlap parts), when all the GLV elements 20 of the GLV element row unit 38*a* and 38*b* are turned on. In other words, a part of pixels constituting the projective light images 36*a* and 36*b* overlap each other (hereinafter these pixels in the overlap region are referred to as overlap pixels). Therefore, the control unit 13 controls so that during image formation, regarding GLV elements 20 corresponding to the overlap pixels (hereinafter referred to as overlap GLV elements), either the overlap GLV elements belonging to the GLV element row unit 38*a* or those belonging to the GLV element row unit 38*b* are selected.

To be more specific, the control unit 13 conducts the following control. During image formation, overlap GLV elements 20 of the GLV element row unit 38*a* corresponding to overlap pixels of the projective light image 36*a* in a region (hereinafter referred to as tolerance region) which is at least a part of the overlap region are allowed to be turned on, while the turning on of the overlap GLV elements 20 of the GLV element row unit 38*b* in the tolerance region is forbidden.

The memory (not shown) of the control unit 13 stores exposure control (exposure condition) data which are composed of data on which GLV elements of the GLV element row units 38*a* and 38*b* are used and which are not used during image formation. Based on the data which the GLV elements 20 are used and which are not used, the control unit 13 processes image signals at a controller thereof, so that exposure of the optical unit 50 is controlled.

With this arrangement, without fine adjustment in a micron order and hence without spending a lot of time in adjustment, it is possible to control necessary GLV elements 20 as if they form a single GLV element line.

The following description will discuss a method of determining exposure conditions on which pixels are to be used (which GLV elements 20 are to be used) among the overlap pixels positioned in the vicinity of the center of the width direction of the photosensitive drum 5*a*. Usually this process is finished before the optical unit 50 is installed in the optical printer, but it is possible to carry out this process after the installment, provided that an adjustment jig is utilized.

Figure 14:
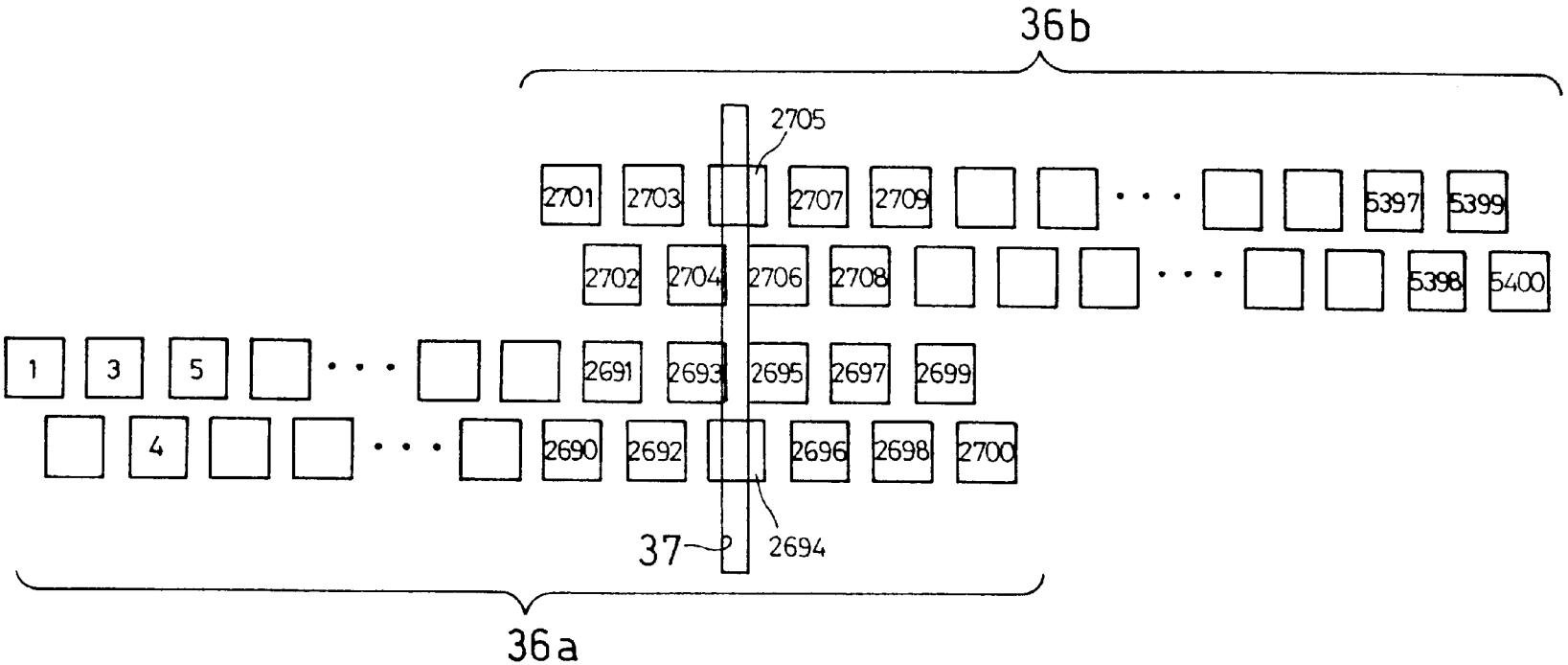
FIG. 14 is a plan view of a projective light image for illustrating the first, second, fifth and sixth methods of determining exposure conditions.

So as to carry out the adjustment, a light receiving slit (light receiving member) 37 of an optical sensor (project light detection means) is provided in the overlap region on the surface 39 of the photosensitive drum 5*a*, as shown in FIG. 14, and is arranged so that outputs of the optical sensor are sent to the control unit 13.

A first method and a second method will be described below, with reference to FIGS. 14 and 15.

Figure 15:
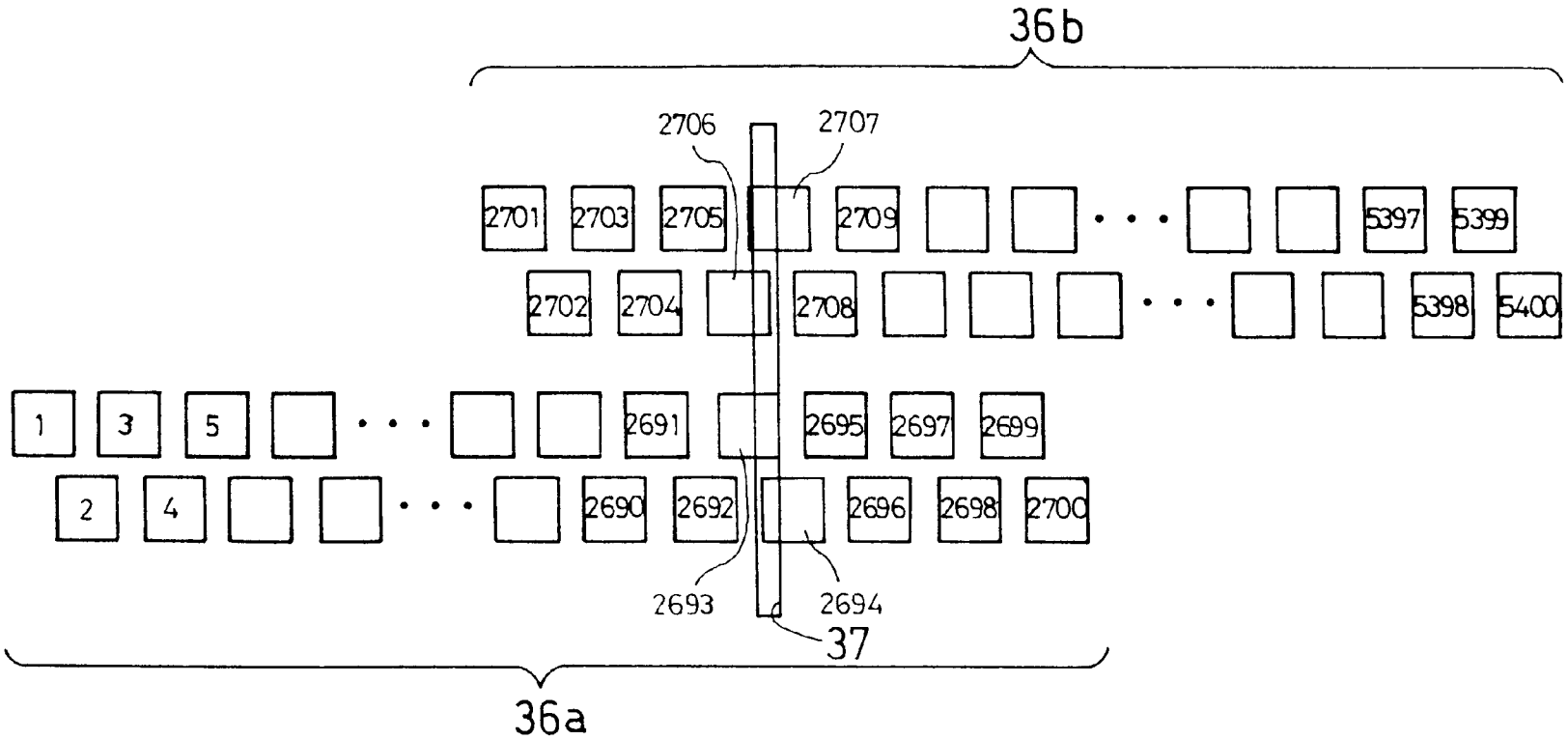
FIG. 15 is a plan view of a projective light image for illustrating the first, second, fifth, and sixth methods of determining exposure conditions.

FIGS. 14 and 15 are enlarged views illustrating the overlap region wherein the end parts of the projective light images 36*a* and 36*b* overlap each other. As illustrated in FIGS. 14 and 15, it is deliberately arranged that the end parts of the projective light images 36*a* and 36*b* overlap each other in a direction orthogonal to the longitudinal direction. Note that in the overlap region, the projective light images 36*a* and 36*b* may fall on a same position, or may fall on positions having a certain distance therebetween in a direction orthogonal to the longitudinal direction of the projective light images 36*a* and 36*b*.

In the present case, for purposes of illustration, the respective GLV elements 20 constituting the GLV element row units 38*a* and 38*b* are given numbers (element number) as addresses, while each element number is also given to each corresponding pixel (element projective light image) constituting the projective light images 36*a* and 36*b*. The pixels of the projective light image 36*a* respectively correspond to the GLV elements 20 numbered 1 through 2700 from the left in FIGS. 14 and 15, while likewise, the pixels of the projective light image 36*b* respectively correspond to the GLV elements 20 numbered 2701 through 5400.

In FIGS. 14 and 15, the position of the light receiving slit 37 of the optical sensor (not shown) is previously fixed so that the light receiving slit 37 is positioned within the overlap region. Behind the light receiving slit 37 (on the side of the surface 39 of the photosensitive drum 5*a*), there is provided a sensor main body (not shown) which has a light receiving plane sufficiently larger than the light receiving slit 37. A width (slit width) of the light receiving slit 37 in the longitudinal direction of the projective light images 36*a* and 36*b* is smaller than a width of each pixel in the longitudinal direction of the projective light images 36*a* and 36*b*, so that the pixels are individually detected.

A length of the light receiving slit 37 in a direction orthogonal to the longitudinal direction of the projective light images 36*a* and 36*b* is set sufficiently greater than a sum of (1) the widths of the projective light images 36*a* and 36*b*, that is, the widths of four pixels, in the direction orthogonal to the longitudinal direction of the projective light images 36*a* and 36*b*, (2) a space between an image formed by the first GLV element row 40*a* and an image formed by the second GLV element row 41*a*, and (3) a space between an image formed by the first GLV element row 40*b* and an image formed by the second GLV element row 41*b* so that the projective light images may not fall outside the light receiving plane of the optical sensor even in the case where the projective light images are provided with a shift in the orthogonal direction to the longitudinal direction.

<First Method>

The following description will discuss a method applied to a case wherein the optical sensor is provided so that the projective light images 36*a* and 36*b* have one pixel each to fall on the light receiving slit 37.

Step 1: First, from an end of the GLV element row unit 38*a*, for example, from the GLV element 20 No. 2700 (hereinafter the GLV element 20 is referred to simply as element), the elements are sequentially turned on and off one by one. The control unit 13 stores as a first address the number of the element which is turned on when the optical sensor detects light, which is "2694" in this case.

Step 2: Likewise, from an end of the GLV element row unit 38*b* in the same direction as that in Step 1, namely, from the element No. 5400, the elements of the GLV element row unit 38*b* are sequentially turned on and off one by one. The control unit 13 stores as a second address the number of the element which is turned on when the optical sensor detects light, which is "2705" in this case.

After the first and second addresses are stored due to the above-described steps 1 and 2, the control unit 13 orders the memory installed in the control unit 13 to store an exposure condition that image formation is carried out with the use of either (1) the elements No. 1 through No. 2694 and No. 2706 through No. 5400, or (2) the elements No. 1 through No. 2693 and No. 2705 through No. 5400, so that only either of the two is turned on regarding the element having the first address or that having the second address. Alternatively, the above exposure condition may be stored in a memory provided in a printer.

So as to more rapidly carry out the detection of the first and second addresses, the steps 1 and 2 may be simultaneously promoted. Specifically, the turning on of the elements of the GLV element row unit 38*a* and 38*b* are simultaneously started with the element No. 2700 and the element No. 5400, respectively.

First, in the GLV element row unit 38*a* wherein the turning on is started with the end thereof which falls in the overlap region, the element No. 2694 is detected by the optical sensor, thereby resulting in that it is found that the first address is "2694". Then, the element No. 2705 of the GLV element row unit 38*b* is detected by the optical sensor, thereby resulting in that it is found that the second address is "2705". Therefore, in this case, the second address is more quickly found compared with the case wherein the step 2 is carried out after the step 1.

The above step 2 has a problem that it takes time to find that the element No. 2705 has the second address, since the turning on of the elements starts with the element No. 5400. Therefore, still another method may be applied, whereby in the step 2 the turning on may be started with somewhere in the middle of the GLV element row unit 38*b*, for example, the element No. 3000. By this method, it is possible to shorten the time required for detecting the addresses.

Then, a reason why the GLV element row units 38*a* and 38*b* are turned on from the respective ends in the same direction in the steps 1 and 2 will be explained in the following description with reference to FIG. 15. In FIG. 14, the projective light images 36*a* and 36*b* projected by the GLV element row units 38*a* and 38*b* have one pixel each to fall on the light receiving slit 37. On the other hand, in FIG. 15, as is clear from comparison with FIG. 14, the optical sensor is provided so that the projective light images 36*a* and 36*b* of the GLV element row units 38*a* and 38*b* have two pixels each to fall on the light receiving slit 37.

In the case shown in FIG. 15, the elements of the GLV element row units 38*a* and 38*b* are turned on one by one from the respective ends in the same direction, thereby resulting as follows, wherein no problem arises.

Step 1: First, the elements of the GLV element row unit 38*a* is turned on and off one by one from an end thereof, for example, from an element No. 2700. The control unit 13 stores as a first address the number of the element which is turned on when the optical sensor detects light, which is "2694" in this case.

Step 2: Likewise, from an end of the GLV element row unit 38*b* in the same direction as that in the step 1, namely, from the element No. 5400, the elements of the GLV element row unit 38*b* are sequentially turned on and off one by one. The control unit 13 stores as a second address the number of the element which is turned on when the optical sensor detects light, which is "2707" in this case.

With the results of the above steps 1 and 2, the control unit 13 orders the memory to store an exposure condition that image formation is carried out with the use of either (1) the elements No. 1 through No. 2694 and No. 2708 through No. 5400, or (2) the elements No. 1 through No. 2693 and No. 2707 through No. 5400.

On the other hand, if the elements are turned on in an opposite direction in the step 2, the following occurs.

Step 2: The elements of the GLV element row unit 38*b* are sequentially turned on and off one by one from the element No. 2701. The control unit 13 stores as a second address the number of the element which is turned on when the optical sensor detects light, which is "2706" in this case.

As a result, since the control unit 13 determines the elements to be used so that only either of the two is turned on regarding the elements of the first and second addresses which have been detected in the steps 1 and 2, the control unit 13 orders the memory to store an exposure condition that image formation is carried out with the use of either (1) the elements No. 1 through No. 2694 and No. 2707 through No. 5400, or (2) the elements No. 1 through No. 2693 and No. 2706 through No. 5400.

Thus, if the elements are turned on in the step 2 in the opposite direction to that in the step 1, the pixels No. 2694 and No. 2707, which are actually lined in a direction orthogonal to the element row longitudinal direction (namely, in a moving direction of the surface 39 of the photosensitive drum 5*a*), are dealt with in picture data as if they have a shift in the axis direction of the photosensitive drum 5*a*. And so are the pixels No. 2693 and No. 2706. Therefore, this leads to a problem that a normal image cannot be formed at these pixels.

The following description will discuss another method which can avoid this problem that pixels which are located at substantially the same position in the axis direction of the photosensitive drum 5*a* are dealt with as if they have a shift in the same direction, with reference to FIGS. 14 and 15.

<Second Method>

The following description will discuss the case illustrated in FIG. 14.

Step 1: First, the elements of the GLV element row unit 38*a* is turned on and off one by one from an end thereof, for example, from an element No. 2700. The control unit 13 stores as a first address the number of the element which is turned on when the optical sensor detects light, which is "2694" in this case.

Step 2: Then, from an end of the GLV element row unit 38*b* in the opposite direction to that in the step 1, namely, from the element No. 2701, the elements of the GLV element row unit 38*b* are sequentially turned on and off one by one. The control unit 13 holds, as a candidate for a second address, the number of the element which is turned on when the optical sensor detects light, which is "2705" in this case. Then, the next element is turned on, and in the case where the optical sensor detects light, the number of the element which is turned on is stored as the second address. In FIG. 14, since light is not detected when the element No. 2706 is turned on, the control unit 13 stores "2705" thus held as the second address.

With the results of the above steps 1 and 2, the control unit 13 orders the memory to store an exposure condition that image formation is carried out with the use of either (1) the elements No. 1 through No. 2694 and No. 2706 through No. 5400, or (2) the elements No. 1 through No. 2693 and No. 2705 through No. 5400.

Then, the case illustrated in FIG. 15 will be described below.

Step 1: First, the elements of the GLV element row unit 38*a* is turned on and off one by one from an end thereof, for example, from an element No. 2700. The control unit 13 stores as a first address the number of the element which is turned on when the optical sensor detects light, which is "2694" in this case.

Step 2: Likewise, from an end of the GLV element row unit 38*b* on the opposite side to that where the turning on of the elements started in the step 1, namely, from the element No. 2701, the elements of the GLV element row unit 38*b* are sequentially turned on and off one by one. The control unit 13 holds, as a candidate for a second address, the number of the element which is turned on when the optical sensor detects light, which is "2706" in this case. Then, the next element is turned on, and in the case where the optical sensor detects light, the number of the element which is turned on is stored as the second address. In FIG. 15, since light is detected when the element No. 2707 is turned on, the control unit 13 stores "2707" as the second address.

With the results of the above steps 1 and 2, the control unit 13 orders the memory to store an exposure condition that image formation is carried out with the use of either (1) the elements No. 1 through No. 2694 and No. 2708 through No. 5400, or (2) the elements No. 1 through No. 2693 and No. 2707 through No. 5400.

By this method, the same result is also obtained in the case where the GLV element row units 38*a* and 38*b* are turned on from respective ends in the opposite direction to the ends corresponding to the overlap region, that is, from the elements No. 1 and No. 5400, respectively. However, in the above described case wherein the turning on starts with the ends corresponding to the overlap region, time required for the steps 1 and 2 can be shortened, thereby causing the setting of the exposure condition to be quickly finished.

The following description will discuss a third method, with reference to FIGS. 16 through 19.

<Third Method>

According to the present method, two elements are turned on at once in each of the GLV element row units 38*a* and 38*b* from respective ends, and one next element is turned on simultaneously when one of the two elements which has been turned on is turned off. Thus, the turning on/off is carried out with respect to the elements one by one.

Figure 16:
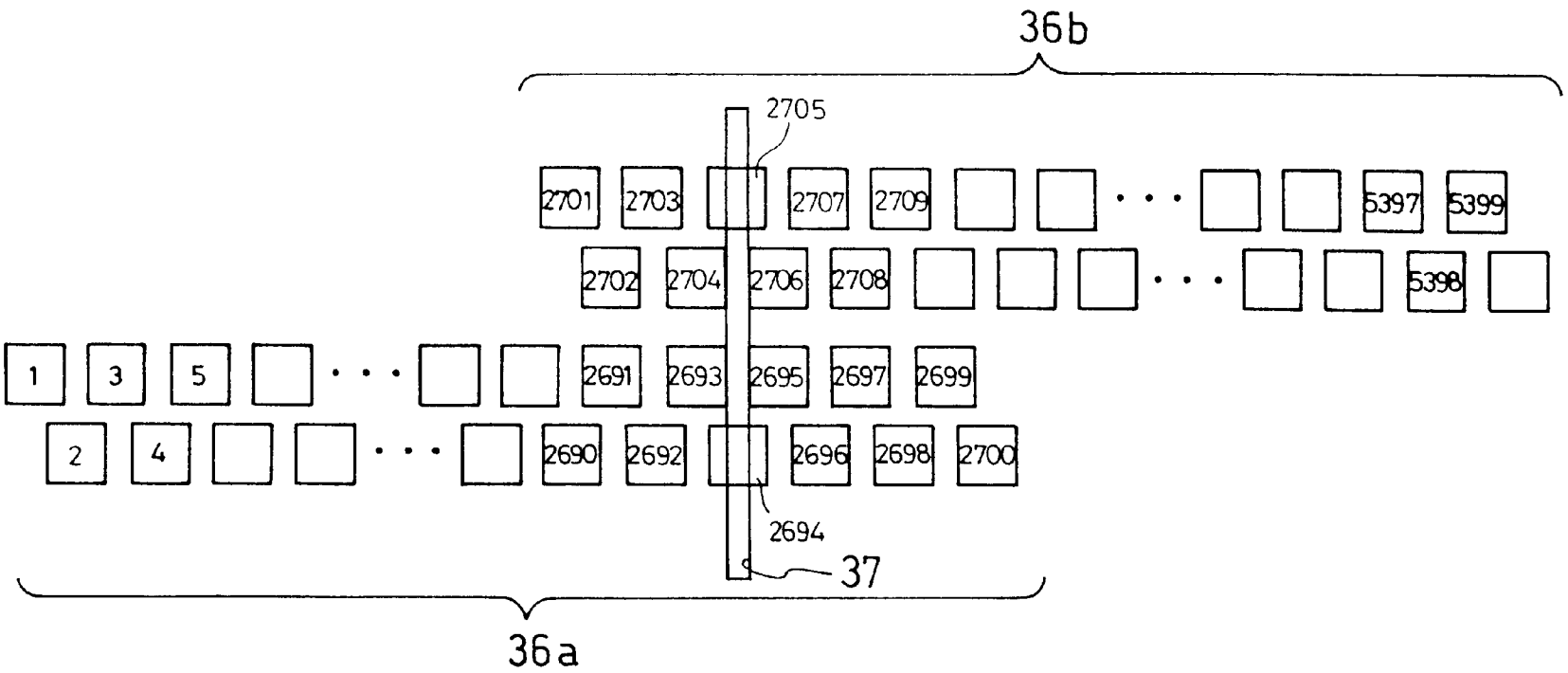
FIG. 16 is a plan view of a projective light image for illustrating the third method of determining exposure conditions.
Figure 17:
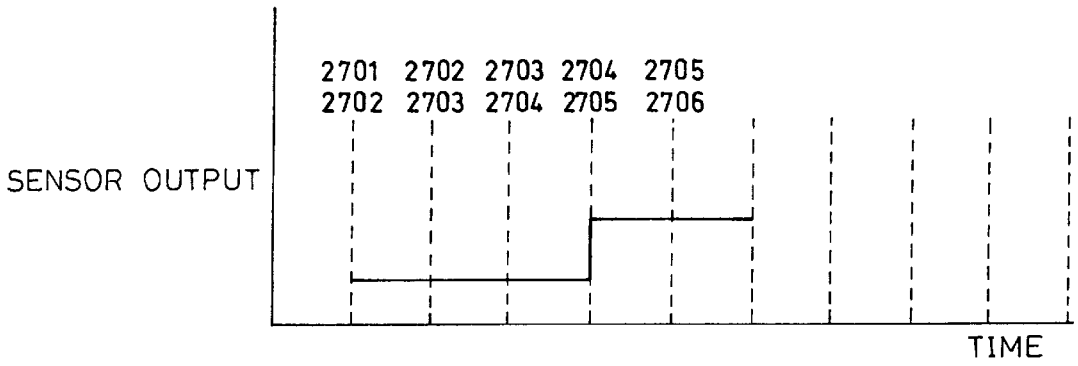
FIG. 17 is a graph illustrating an output of an optical sensor in the overlap region of the projective light image shown in FIG. 16.

A case illustrated in FIG. 16 will be discuss below.

When the elements of the GLV element row unit 38*b* (in FIG. 16, the projective light image 36*b* formed by the GLV element row unit 38*b* is shown) are turned on from the element No. 2701, the turning-on operation is carried out as follows: the two elements No. 2701 and No. 2702 are first turned on, then the elements No. 2702 and No. 2703, and thereafter the elements No. 2703 and No. 2704 are turned on. In this case, the optical sensor has an output shown in FIG. 17.

In this case, light is detected by the optical sensor when the elements No. 2704 and No. 2705 are turned on, and the control unit 13 stores quantity of the light. Then, the control unit 13 judges that the light detected by the optical sensor is a light projected by the element No. 2705, since no increase in light quantity is observed when the elements No. 2705 and No. 2706 are turned on. Therefore, the control unit 13 stores "2705" as a first address.

With respect to the GLV element row unit 38*a* (in FIG. 16, the projective light image 36*a* formed by the GLV element row unit 38*a* is shown), the control unit 13 likewise judges that a detected light is a light projected by the element No. 2694, and stores "2694" as a second address.

After the detection of the first and second addresses, the same process as that taken in the first and second method is carried out.

Figure 18:
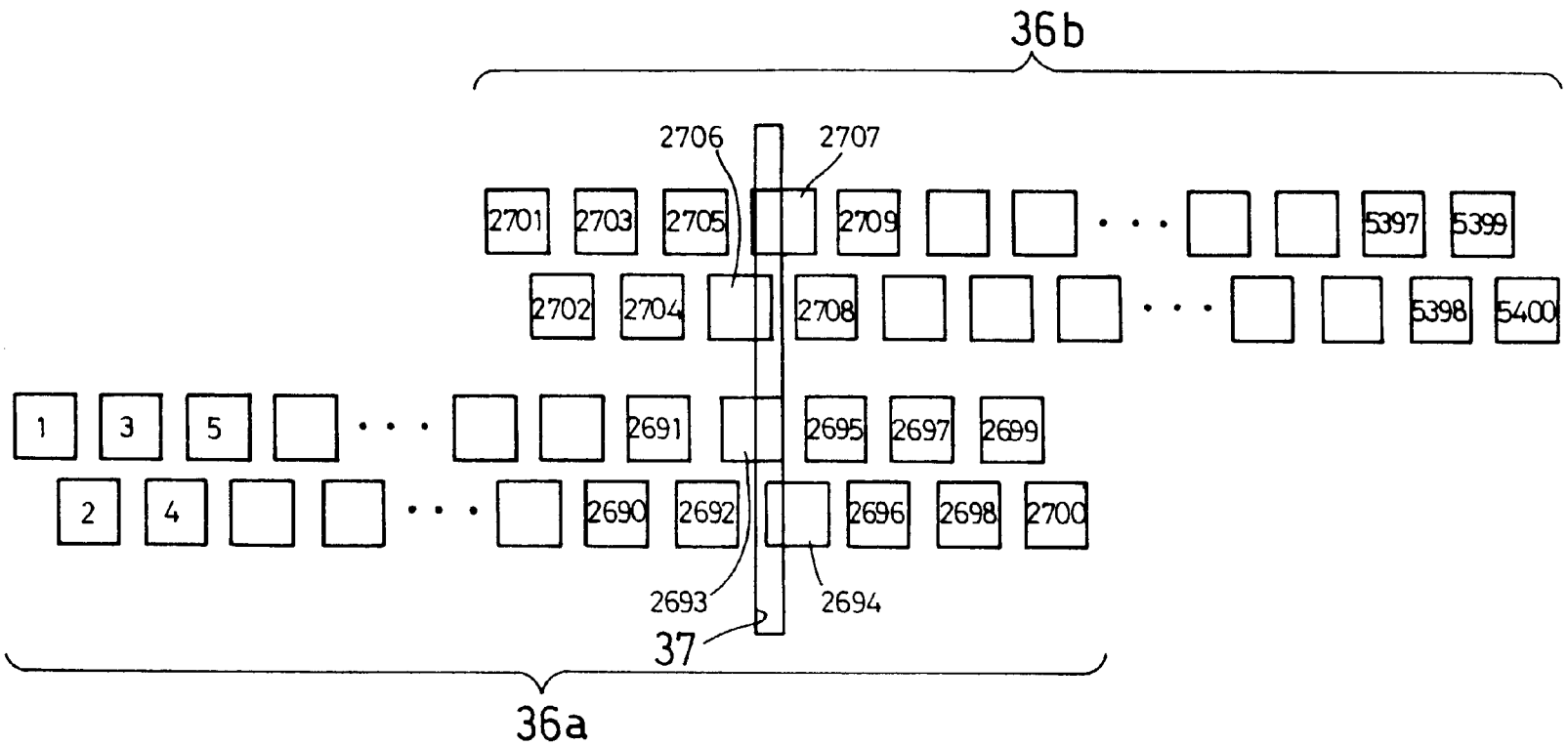
FIG. 18 is a plan view of a projective light image for illustrating the third method of determining exposure conditions.

The following description will discuss a case illustrated in FIG. 18.

Figure 19:
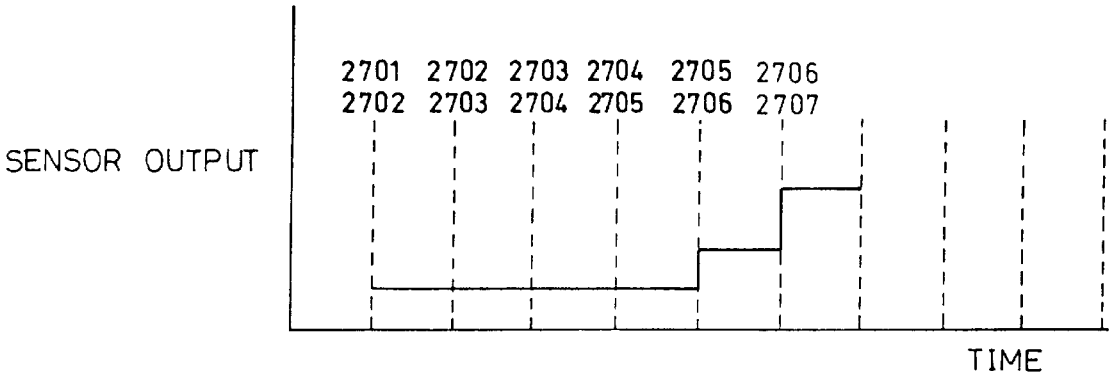
FIG. 19 is a graph illustrating an output of the optical sensor in the overlap region of the projective light image shown in FIG. 18.

In the case where the elements of the GLV element row unit 38*b* (in FIG. 18, the projective light image 36*b* formed by the GLV element row unit 38*b* is shown) are turned on from the element No. 2701, light is detected by the optical sensor when the elements No. 2706 and No. 2707 are turned on, and the control unit 13 stores a quantity of the light this time. When the elements No. 2706 and No. 2707 are turned on, an increase in light quantity is detected as illustrated in FIG. 19, and the control unit 13 judges that the light detected by the optical sensor is projected by the two elements No. 2706 and No. 2707. Therefore the control unit 13 stores "2707" as a first address.

With respect to the GLV element row unit 38*a* (in FIG. 18, the projective light image 36*a* projected by the GLV element row unit 38*a* is shown), the control unit 13 likewise judges that a detected light is projected by the elements No. 2693 and No. 2694, and stores "2694" as a second address.

After the detection of the first and second addresses, the same process as that taken in the first and second method is carried out. In this case as well, it is preferable to carry out the turning-on operation from the respective ends corresponding to the ends of the projective light images on a side of the overlap region, since it is time-saving.

Figure 20:
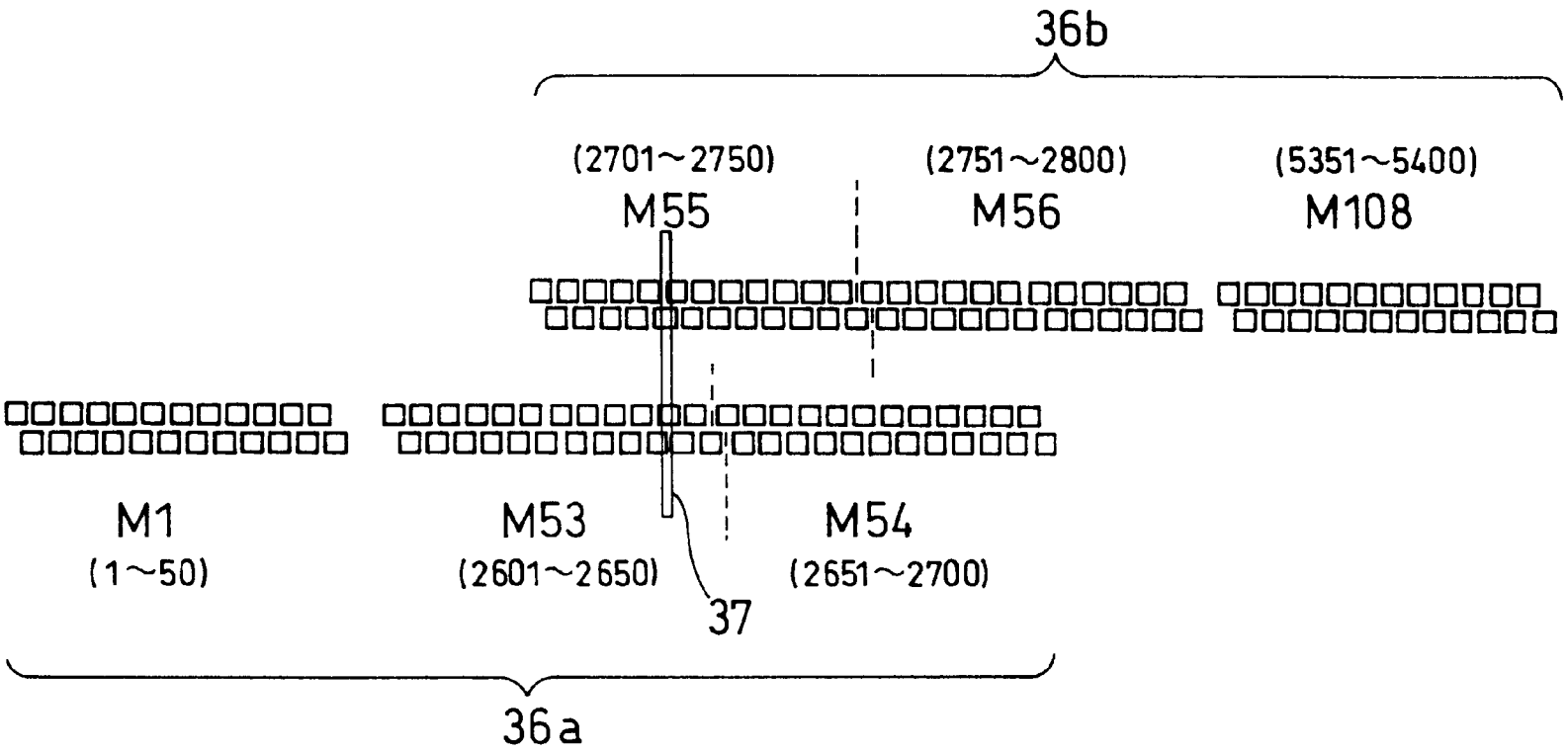
FIG. 20 is a plan view of a projective light image for illustrating the fourth, fifth and sixth methods of determining exposure conditions.

The following description will discuss a fourth method, with reference to FIG. 20.

<Fourth Method>

According to the method, the elements of the respective GLV element row units 38*a* and 38*b* are divided into blocks, each having a plurality of the elements, the number of which is predetermined.

For example, as illustrated in FIG. 20, the elements constituting the GLV element row units 38*a* and 38*b* are divided into blocks each having 50 elements. The blocks constituting the GLV element row unit 38*a* (in FIG. 20, the projective light image 36*a* formed by the GLV element row unit 38*a* is shown) are designated by M1 through M54, while the blocks constituting the GLV element row unit 38*b* (in FIG. 20, the projective light image 36*b* formed by the GLV element row unit 38*b* is shown) are designated by M55 through M108. In the GLV element row unit 38*a*, all the 50 elements in the block M1 are first turned on and off, then, in the block M2, and then, in the block M3. Thus, until light is detected by the optical sensor, the elements are turned on and off block by block. The same operation is also carried out with respect to the GLV element row unit 38*b*.

In the case shown in FIG. 20, projected lights are detected when the elements of the block M53 of the GLV element row unit 38*a* are turned on, and when the elements of the block M55 of the GLV element row unit 38*b* are turned on. Thereafter, the first or second method described above are applied to the blocks M53 and M55. By this method, the element number to be recorded as the first address and that to be recorded as the second address are quickly determined in the GLV element row units 38*a* and 38*b*, respectively. In this case as well, the operation of turning on and off the elements is preferably started with the blocks whose project images fall in the overlap region, since it is time-saving.

<Fifth Method>

By the above-described first, second and fourth methods, the elements are sequentially turned on and off one by one. On the other hand, by the present method, the elements once turned on are not turned off until the projected light is detected by the optical sensor. With this method, fatigue of the microbridges 22 (see FIG. 3) of the elements caused by unnecessary turning on/off of the elements can be avoided, thereby prolonging life of the elements. This is discussed in detail in the following description.

An improved version of the first method in this case is described below, while referring to FIG. 14.

Step 1: The elements of the GLV element row unit 38*a* are sequentially turned on from an end, for example, from the element No. 2700. The control unit 13 stores as the first address the number of the element which became turned on just before the optical sensor detects light, "2694" in this case. Thereafter all the elements of the GLV element row unit 38*a* are turned off.

Step 2: Likewise, the elements of the GLV element row unit 38*b* are sequentially turned on from an end in the same direction as in the step 1, namely, from the element No. 5400. The control unit 13 stores the number of the element which became turned on just before the optical sensor detects light, "2705" in this case, as the second address. Thereafter all the elements of the GLV element row unit 38*b* are turned off.

With the results of the above steps 1 and 2, the control unit 13 orders the memory to store an exposure condition that image formation is carried out with the use of either (1) the elements No. 1 through No. 2694 and No. 2706 through No. 5400, or (2) the elements No. 1 through No. 2693 and No. 2705 through No. 5400.

An improved version of the second method in this case is described below, while referring to FIG. 15.

Step 1: The elements of the GLV element row unit 38*a* are sequentially turned on from an end, for example, from the element No. 2700. The control unit 13 stores the number of the element which became turned on just before the optical sensor detects light, "2694" in this case, as the first address. Thereafter all the elements of the GLV element row unit 38*a* are turned off.

Step 2: Likewise, the elements of the GLV element row unit 38*b* are sequentially turned on from an end in the direction opposite to that in the step 1, namely, from the element No. 2701. The control unit 13 holds the number of the element which became turned on just before the optical sensor detects light, "2706" in this case. Thereafter all the elements of the GLV element row unit 38*b* are turned off. Then, the next element is turned on, and in the case where the optical sensor detects light, the control unit 13 stores as the second address the number of the latter element. In FIG. 15, light is detected when the element No. 2707 is turned on. Therefore, in this case, the control unit 13 stores "2707" as the second address.

With the results of the above steps 1 and 2, the control unit 13 orders the memory to store an exposure condition that image formation is carried out with the use of either (1) the elements No. 1 through No. 2694 and No. 2708 through No. 5400, or (2) the elements No. 1 through No. 2693 and No. 2707 through No. 5400.

An improved version of the fourth method in this case is described below, while referring to FIG. 20.

The block M1 of the GLV element row unit 38*a* is turned on first, and the other blocks are also sequentially turned on one by one, until the optical sensor detects light. The same operation is carried out with respect to the GLV element row unit 38*b*. In the case shown in FIG. 20, the optical sensor detects light when the elements of the block M53 of the GLV element row unit 38*a* are turned on and when the elements of the block M55 of the GLV element row unit 38*b* are turned on. Then, the first or second method is applied to each of the blocks M53 and M55. By this method, the element number to be recorded as the first address and that to be recorded the second address are quickly determined in the blocks. In this case as well, the operation of turning on the blocks is preferably started with the blocks whose projective light images fall in the overlap region, since it is time-saving.

<Sixth Method>

This method is reverse to the fifth method in a sense that all the elements are once turned on, and then, they are sequentially turned off. This method has an advantage that any malfunction of the elements or a driving circuit can be detected when all the elements are turned on at the beginning. This will be discussed in detail in the following description.

An improved version of the first method in this case is described below, while referring to FIG. 14.

Step 1: All the elements of the GLV element row unit 38*a* are turned on once, and then, they are sequentially turned off from an end, for example, from the element No. 2700, one by one. The control unit 13 stores as the first address the number of the element which became turned off just before the optical sensor detects no light, "2694" in this case. Thereafter all the elements of the GLV element row unit 38*a* are turned off.

Step 2: Likewise, all the elements of the GLV element row unit 38*b* are turned on, and then, they are sequentially turned off one by one from an end in the same direction as in the step 1, namely, from the element No. 5400. The control unit 13 stores as the second address the number of the element which became turned off just before the optical sensor detects no light, "2705" in this case. Thereafter all the elements of the GLV element row unit 38*b* are turned off.

With the results of the above steps 1 and 2, the control unit 13 orders the memory to store an exposure condition that image formation is carried out with the use of either (1) the elements No. 1 through No. 2694 and No. 2706 through No. 5400, or (2) the elements No. 1 through No. 2693 and No. 2705 through No. 5400.

An improved version of the second method in this case is described below, while referring to FIG. 15.

Step 1: All the elements of the GLV element row unit 38*a* are turned on, and then, they are sequentially turned off one by one from an end, for example, from the element No. 2700. The control unit 13 stores as the first address the number of the element which became turned off just before the optical sensor detects no light, "2693" in this case. Thereafter all the elements of the GLV element row unit 38*a* are turned off.

Step 2: Likewise, all the elements of the GLV element row unit 38*b* are turned on, and then, they are sequentially turned off one by one from an end in the direction opposite to that in the step 1, namely, from the element No. 2701. The control unit 13 holds the number of the element which became turned off just before the optical sensor detects no light, "2707" in this case. Then, the element which was turned off one element before is turned on, and in the case where the optical sensor detects light, the control unit 13 stores as the second address the number of the latter element. In FIG. 15, light is detected when the element No. 2706 is turned on. Therefore, in this case, the control unit 13 stores "2706" as the second address.

With the results of the above steps 1 and 2, the control unit 13 orders the memory to store an exposure condition that image formation is carried out with the use of either (1) the elements No. 1 through No. 2693 and No. 2707 through No. 5400, or (2) the elements No. 1 through No. 2694 and No. 2708 through No. 5400.

An improved version of the fourth method in this case is described below, while referring to FIG. 20.

All the blocks of the GLV element row unit 38*a* are turned on first, and then, the blocks are sequentially turned off one by one, until the optical sensor detects no light. The same operation is carried out with respect to the GLV element row unit 38*b*. In the case shown in FIG. 20, When the block M53 of the GLV element row unit 38*a* and the block M55 of the GLV element row unit 38*b* are turned off, the optical sensor detects no light. Then, the first or second method is applied to each of the blocks M53 and M55. By this method, the element number to be recorded as the first address and that to be recorded as the second address are quickly determined in the respective blocks. In this case as well, the operation of turning on the blocks is preferably started with the blocks whose projective light images fall in the overlap region, since it is time-saving.

<Seventh Method>

There is a still another method, whereby, the total number of the elements belonging to each of the GLV element row units 38*a* and 38*b* being given as S, $S/2^n$ (n=0, 1, 2, 3, . . . ) elements are turned on while the optical sensor is kept in operation. The value of n is increased from 0 by an increment of 1 each, and the number of the element which is turned on when $S/2^n=1$ is identified.

In other words, by the method, the following step is repeated: dividing selected elements into two blocks so that the respective number of elements belonging to the blocks are substantially equal to each other, checking whether or not the optical sensor detects element project light with respect to each block, and selecting the block whose element project light is detected. Thus, the elements whose project lights are detected are identified.

This will be more concretely discussed in the following description, with reference to FIG. 21. Though the present method is applied to the whole elements of the GLV element row units 38*a* and 38*b*, only the case with the GLV element row unit 38*b* will be described below. Here, S, which represents the number of the elements belonging to the GLV element row unit 38*b*, is 2700.

First of all, in the first stage (n=0), all the 2700 elements are turned on so as to check whether or not any malfunction or disorder occurs to the elements and the circuits.

Figures 21A, 21B, 21C, 21D, 21E, 21F, 21G, 21H:
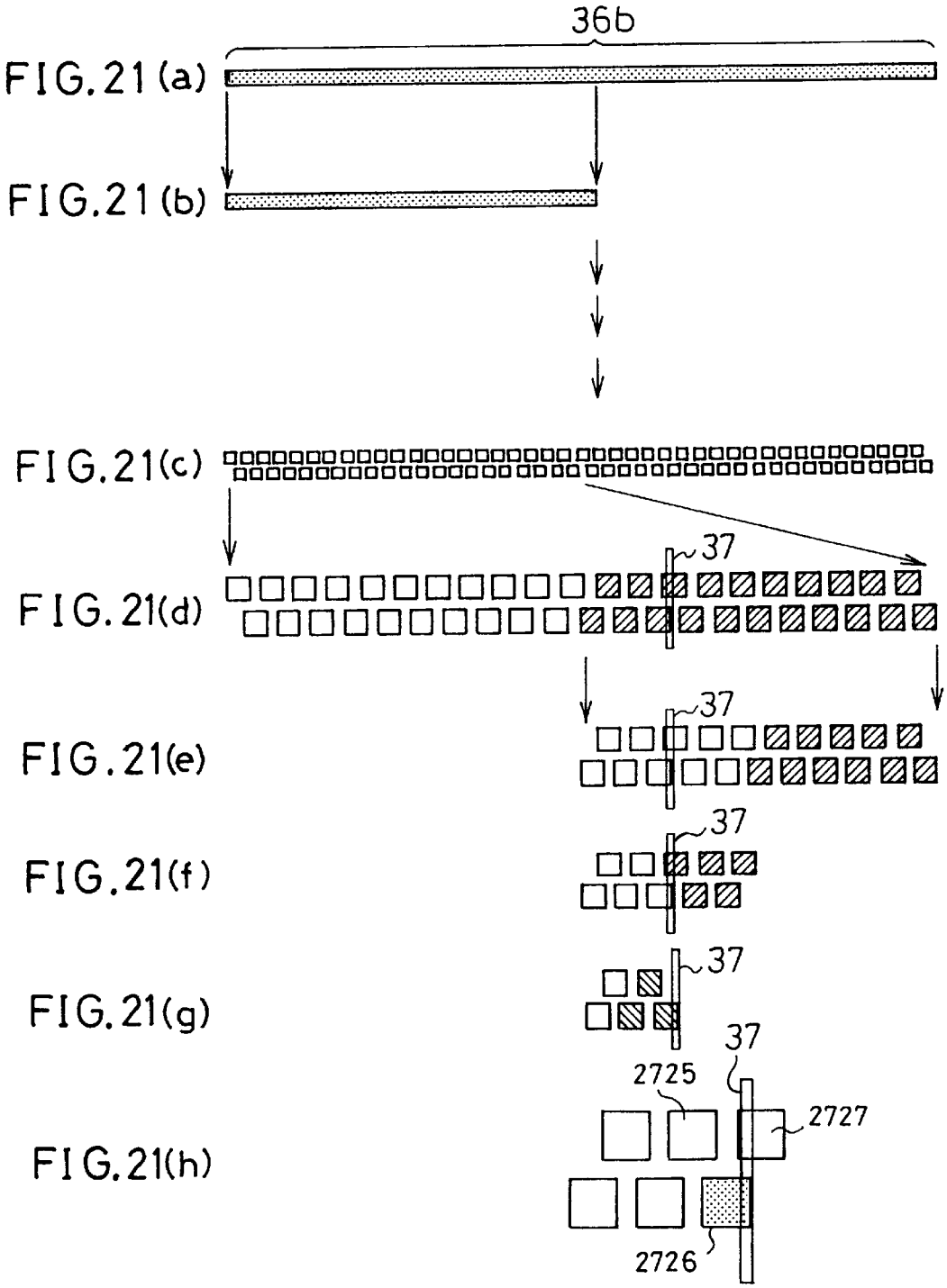
FIGS. 21(*a*) through 21(*h*) are plan views of a projective light image for illustrating the seventh method of determining exposure conditions.

In the second stage (n=1), $S/2^1$ (=1350) elements corresponding to the left half of the pixels of the projective light image 36*b* in FIG. 21(*a*) are turned on as illustrated in FIG. 21(*b*), and whether or not light is detected by the optical sensor is checked. The value of n is increased to 2, 3, 4, 5, 6, . . . , and the same operation is carried out in each stage (see FIG. 21(*c*)).

As shown in FIG. 21(*d*), when n=7 (the eighth stage), 21 ($\fallingdotseq S/2^5$) elements corresponding to the pixels of the left half among 42 ($\fallingdotseq S/2^6$) selected elements, and the other 21 elements corresponding to the pixels in the right which are shown by hatching, are individually turned on and it is checked whether or not light is detected by the optical sensor. In this case, no light is detected when the 21 elements corresponding to 21 pixels of the left half in FIG. 21(*d*) are turned on. Therefore, the 21 elements corresponding to the 21 pixels of the right half in FIG. 21(*d*) are selected.

Then, as illustrated in FIG. 21(*e*), the 21 selected elements are divided into two blocks respectively having 10 ($\fallingdotseq S/2^8$) elements corresponding to the pixels of the left half in the figure and the other 11 ($\fallingdotseq S/2^8$) elements corresponding to the pixels of the right half shown in the figure by hatching, and n is set to 8 (the ninth stage). In this case, light is detected by the optical sensor when 10 elements corresponding to 10 pixels of the left half in FIG. 21(*e*) are turned on. Therefore, the 10 elements corresponding to the 10 pixels of the left half are selected.

As illustrated in FIG. 21(*f*), the selected 10 elements are further divided into two blocks respectively having 5 ($\fallingdotseq S/2^9$) elements corresponding to 5 pixels of the left half in the figure and 5 ($\fallingdotseq S/2^9$) elements corresponding to the pixels of the right half illustrated by hatching, and n is set to 9 (the tenth stage). In this case, light is detected by the optical sensor when 5 elements corresponding to the 5 pixels of the left half in FIG. 21(*f*) are turned on. Therefore, the 5 elements corresponding to the 5 pixels of the left half are selected.

Sequentially, as illustrated in FIG. 21(*g*), the selected five elements are divided into two blocks respectively having 2 ($\fallingdotseq S/2^{10}$) elements corresponding to the pixels of the left half in the figure and 3 ($\fallingdotseq S/2^{10}$) elements corresponding to the pixels of the right half in the figure illustrated by hatching, and n is set to 10 (the eleventh stage). In this case, light is detected by the optical sensor when 3 elements corresponding to the 3 pixels of the right half in FIG. 21(*g*) are turned on. Therefore, the three elements corresponding to the 3 pixels of the right half are selected.

Finally, as illustrated in FIG. 21(*h*), when n=11 (the twelfth stage), light projected by the element No. 2726 is detected when 1 ($\fallingdotseq S/2^{10}$) element of the right half in the figure among the three selected elements is turned on. Thereafter, whether or not the optical sensor detects light is checked with respect to the elements No. 2725 and No. 2727. In this case, light projected by the element No. 2726 and that by the element No. 2727 are detected.

Likewise, regarding the GLV element row unit 38*a* as well, elements whose light is detected by the optical sensor can be identified. Thereafter, as is the case with the second method, which elements are used for forming images can be decided.

To be more specific, as is the case with the GLV element row unit 38*b*, it is assumed that light projected by the element No. 2693 and that by the element No. 2694 of the GLV element row unit 38*a* are detected.

Then, the second method is applied to the elements No. 2726 and No. 2727 of the GLV element row unit 38*b* and the elements No. 2693 and No. 2694 of the GLV element row unit 38*a* (see FIG. 15, but note that the element numbers of the GLV element row unit 38*b* differ from those in FIG. 15). As a result, the first and second addresses are found to be 2694 and 2727, respectively.

In fact, however, there is no need to apply the second method. Because there exist only the following four combinations of the elements to be detected.

(1) In the case where light of the elements No. x and No. x+1 of the GLV element row unit 38*a* and the elements No. y and No. y+1 of the GLV element row unit 38*b* is detected, the first and second addresses are found to be x+1 and y+1, respectively.

(2) In the case where light of the elements No. x and No. x+1 of the GLV element row unit 38*a* and the element No. y of the GLV element row unit 38*b* is detected, the first and second addresses are found to be x+1 and y, respectively.

(3) In the case where light of the element No. x of the GLV element row unit 38*a* and the elements No. y and No. y+1 of the GLV element row unit 38*b* is detected, the first and second addresses are found to be x and y+1, respectively.

(4) In the case where light of the element No. x of the GLV element row unit 38*a* and the element No. y of the GLV element row unit 38*b* is detected, the first and second addresses are found to be x and y, respectively.

Thus, the first and second addresses are automatically determined depending on the combination of the detected elements of the GLV element row units 38*a* and 38*b*.

As has been described, the first and second addresses are found by the various methods.

The control unit 13 conducts the following control during image formation. Based on the first and second addresses thus obtained, the control unit 13 forbids the turning on of, among the overlap elements of the GLV element row unit 38*a*, those provided on a side of the end of the GLV element row unit 38*a* corresponding to an end of the projective light image 36*a* on a side of the overlap region with resect to the GLV element having the first address, and the turning on of, among the overlap elements of the GLV element row unit 38*b*, those provided on a side of the end of the GLV element row unit 38*b* corresponding to an end of the projective light image 36*b* on a side of the overlap region with respect to the element having the second address. At the same time, either the GLV element 20 having the first address or that having the second address is allowed to be turned on, while the turning on of the other is forbidden.

To be more concrete, in the case illustrated in FIG. 14 wherein the control unit 13 stores "2694" as the first address and "2705" as the second address, (1) the elements No. 1 through No. 2694 and No. 2706 through No. 5400 are allowed to be turned on while the turning on of the other elements is forbidden, or (2) the elements No. 1 through No. 2693 and No. 2705 through No. 5400 are allowed to be turned on while the turning on of the other elements is forbidden.

Then, based on the first and second addresses thus obtained by any one of the above methods as well as a shift between the projective light images 36*a* and 36*b* in a direction orthogonal to the longitudinal direction of the projective light images, image signals are processed by the controller section of the control unit 13, and pictures are obtained by turning on/off the respective GLV elements 20. Control of the image signals regarding the shift between the projective light images 36*a* and 36*b* in the direction orthogonal to the longitudinal direction of the projective light images can be carried out in the same manner as that described in conjunction with the first embodiment.

Note that this function of the control unit 13 may be played by a control device of the optical printer. Besides, it may be arranged that respective data of the first and second addresses and the shift between the projective light images 36*a* and 36*b* in the direction orthogonal to the longitudinal direction of the projective light images are once stored in the memory of the control unit 13, and the data may be read by the control device of the optical printer, after the optical unit 50 is installed in the optical printer. In such a case, in a process of installing the optical unit or changing the optical units, time and labor can be saved, thereby reducing the manufacturing processes and time.

As has been so far described, the optical unit 50 of the optical printer in accordance with the present embodiment is arranged so that: (1) the GLV elements 20 are utilized as the optical modulator, and a necessary number of the GLV elements 20 are divided into a group belonging to the GLV element row unit 38*a* and another belonging to the GLV element row unit 38*b*; (2) the projective light images 36*a* and 36*b* respectively projected by the GLV element row units 38*a* and 38*b* on the photosensitive drum 5*a* form a substantially linear image, with the end parts of the projective light images 36*a* and 36*b* in the vicinity of the center of the image overlapping each other.

Therefore, the optical unit 50 of the present invention has an effect of meeting the demand for high-speed printing and high-quality printing using a half tone. Besides, the total length of the GLV element row units 38*a* and 38*b* can be reduced in comparison with the conventional arrangement wherein a necessary number of the GLV elements 20 are provided in one line, thereby resulting in that the optical modulator can be miniaturized and the yield of the optical modulators can be improved with the use of the present semiconductor technology.

In addition, in this case, the GLV elements 20 are provided in a staggered manner in each of the GLV element row unit 38*a* and 38*b*, thereby allowing the further miniaturization. This arrangement has one more effect that insufficient exposure caused by the peripheral parts of the GLV elements 20 in one row can be compensated with exposure by the GLV elements 20 in the other row which are provided just beside the peripheral parts.

Furthermore, since the projective light images 36*a* and 36*b* are arranged so as to partially overlap each other or partially fall in the same region, the projective light images 36*a* and 36*b* are sequentially formed in the longitudinal direction, irrelevant to dispersion of the individual optical unit 50. The control unit 13 is arranged so as to control during the image formation so that among the GLV elements 20 corresponding to the pixels in the overlap region, either of the GLV elements 20 belonging to the GLV element row unit 38*a* or those belonging to the GLV element row unit 38*b* are turned on. Therefore, even in the overlap region, the pixels and the GLV elements 20 correspond each other in a one-to-one ratio, and the GLV element row units 38*a* and 38*b* are controlled as if they are a single element row having a necessary number of GLV elements.

In the case where it is attempted that a necessary number of GLV elements are divided into a plurality of GLV element rows and projective light images formed by the GLV element rows are sequentially formed in the longitudinal direction of the projective light images so that the pixels are sequentially provided, it is necessary to provide a pixel at an end of an element row just beside a pixel at an end of another element row. To do so, position adjustment in a micron order is required. However, such an adjustment is difficult by a mechanical adjustment method, and it takes a lot of time to do so. But, with the arrangement described above, the position adjustment in a micron order is not required and the adjustment in the above arrangement does not require much time. Therefore, the above arrangement can be realized.

Note that the types and positions of optical members such as lenses, slits, or the like, used in the present embodiment may be varied in many ways, and do not limit the scope of the invention. Besides, the method determining which GLV elements are turned on and which are turned off among the overlap elements in the GLV element rows may also be varied in many ways, provided that the method is capable of controlling a plurality of GLV element rows so that they appear a single row.

[Third Embodiment]

Figure 22:
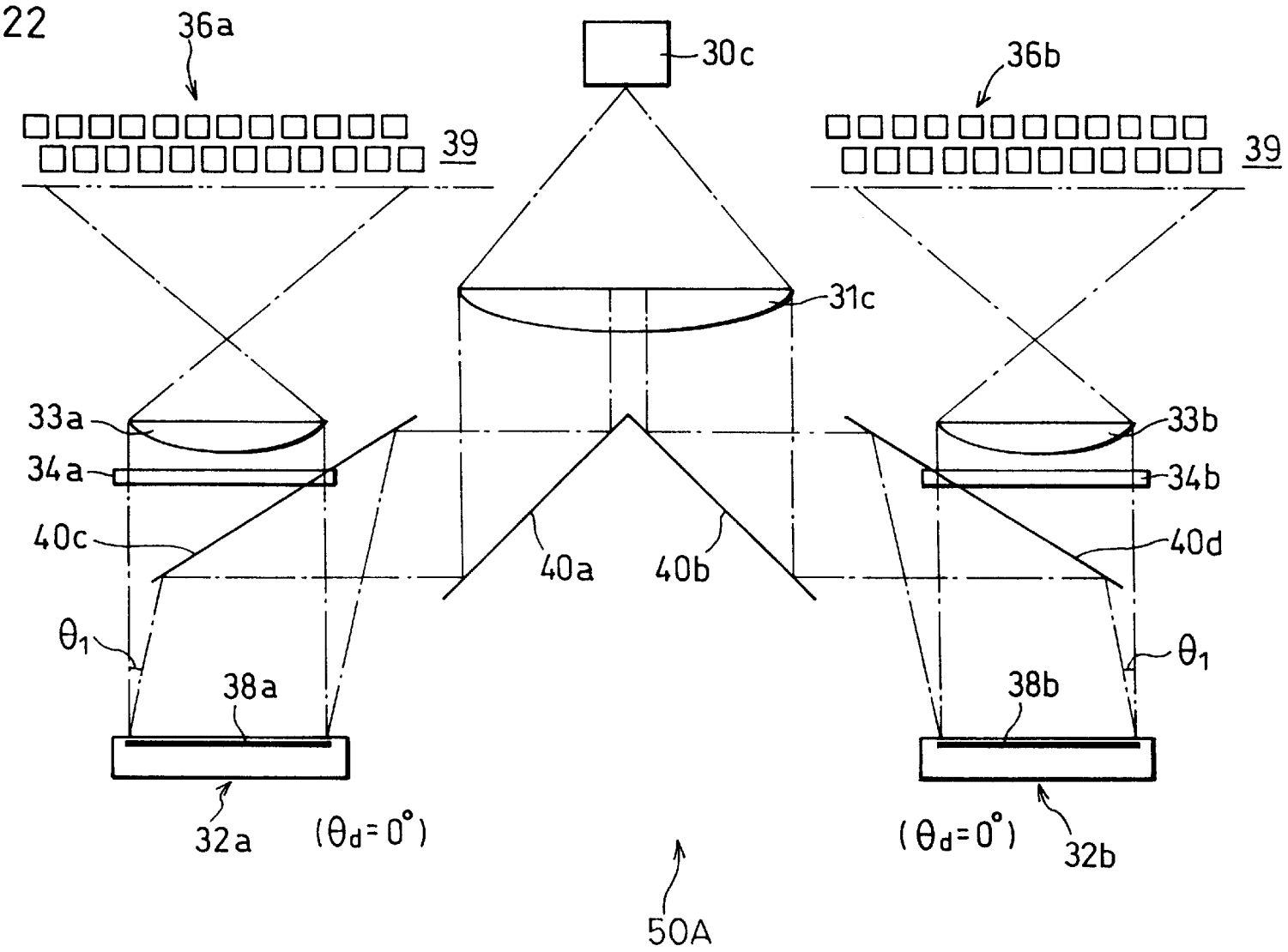
FIG. 22 is a perspective view illustrating an arrangement of the optical unit of the optical printer in accordance with still another embodiment of the present invention.

The following description will discuss still another embodiment of the present invention, while referring to FIGS. 12 and 22. The members having the same structure (function) as those in the above-mentioned embodiment will be designated by the same reference numerals and their description will be omitted.

An optical printer as an image forming apparatus in accordance with the present embodiment has substantially the same structure as the optical printer of the second embodiment illustrated in FIG. 12, except that an optical unit (exposure means) 50A is installed instead of the optical unit 50 of the optical printer of the second embodiment.

The following description will discuss the structure of the optical unit 50A of the optical printer of the present embodiment, with reference to FIG. 22. FIG. 22 is a schematic view illustrating an arrangement of the optical unit 50A wherein a necessary number of GLV elements are divided into two groups.

In the optical printer, during image formation, light emitted by a monochromatic light source unit (light source) 30*c* in accordance with control by a control unit 13 is collimated by a collimating lens 31*c* and the light thus collimated is divided into two by reflecting plates 40*a* and 40*b* (light dividing means). The lights thus obtained by division are reflected by reflecting plates 40*c* and 40*d*, respectively, and are projected onto the GLV optical modulators 32*a* and 32*b* from the upper front thereof, respectively (in FIG. 22, for purposes of illustration, the positions of the reflecting plates 40*c* and 40*d* are shifted to the left and the right, respectively, along the respective reflection planes).

The GLV optical modulators 32*a* and 32*b* turns on/off the GLV elements 20 in accordance with image signals processed by the control unit 13, based on the above described motion principles. Lights emitted only by the GLV elements 20 in the ON state pass through slits 34*a* and 34*b* and are projected to projection lenses 33*a* and 33*b*, respectively. The lights thus projected on the projection lenses 33*a* and 33*b* are projected as pixels onto a surface 39 of a photosensitive drum. As is the case with the second embodiment, the optical unit 50A is also arranged so that when all the GLV elements of the GLV element row units 38*a* and 38*b* are turned on, an end of the projective light image 36*c* and that of the projective light image 36*d* overlap each other, in the vicinity of the center of the photosensitive drum surface 39, in the moving direction of the surface 39 of the photosensitive drum 5*a*.

The first and second addresses are obtained in the same manner as in the first embodiment, so that which pixels are used among the overlap pixels (or, which GLV elements are used among the overlap elements) is determined. Then, based on the first and second addresses and a shift between the projective light images 36*c* and 36*d* in a direction orthogonal to the longitudinal direction of the projective light images, the image signals are processed by the control unit 13, and pictures are formed by turning on/off the GLV elements in accordance with the image signals.

As described, the optical printer in accordance with the present embodiment includes only one monochromatic light source unit 30*c*. Therefore, in addition to the various effects described in conjunction with the second embodiment, the following effects can be obtained: it is possible to miniaturize the optical unit 50A, to reduce material costs, and to reduce power consumption.

Note that the types and positions of optical members such as lenses, slits, or the like, used in the present embodiment may be varied in many ways, and do not limit the scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

an image carrier having a surface movable in a first moving direction;

exposure means for forming an electrostatic latent image on said image carrier, said exposure means including a light source for emitting light and an optical modulator for modulating light from said light source, the exposure means is aligned with the image carrier to project a modulated light on said image carrier to form the electrostatic latent image thereon;

a development means for developing the electrostatic latent image to form a visual image, wherein said development means is juxtaposed with the image carrier; and transfer means for transferring the visual image from the image carrier and onto a recording material, wherein said optical modulator includes element rows having a first element row composed of a plurality of grating light valve elements and a second element row composed of a plurality of grating light valve elements, the first element row being parallel to the second element row, and the element rows being perpendicular to the first moving direction of the surface of said image carrier, the plurality of grating light valve elements in the first element row are staggered with respect to the grating light valve elements in the second element row such that a line extending from a center of each element of the second element row perpendicularly to a center line of the first element row runs between neighboring grating light valve elements of the first element row, and such that element row the grating light valve elements in the element rows are separated by a width narrower than a width of a grating light valve element in the first element row, and the grating light valve elements each have a first state of reflecting light and a second state of diffracting light, and each element is individually switchable between said first state and said second state.

2. The image forming apparatus as set forth in claim 1, wherein the element rows are arranged so that projective light images of each grating light valve element of the element rows are continuously formed on said image carrier.

3. The image forming apparatus as set forth in claim 2, wherein the element rows are provided so that respective effectual diffraction regions of the element rows are continuously provided.

4. An image forming apparatus as set forth in claim 1, further comprising exposure control means for turning on the grating light valve elements of the second element row with a delay AT after the grating light valve elements of the first element row is turned on, the delay AT satisfying:

$$AT=L/V$$

where L represents a distance between projective light images respectively formed by the first and second element rows on said image carrier, and V represents a moving velocity of the surface of said image carrier.

5. The image forming apparatus as set forth in claim 1, wherein the gating light valve elements abut each other in each of the first and second element rows.

6. The image forming apparatus as set forth in claim 1, wherein in each of the first and second element rows, the grating light valve elements are provided at spaces, each space being not greater than a width of an effectual diffraction region of the grating light valve element in the longitudinal direction of the first element row.

7. The image forming apparatus as set forth in claim 1, wherein the first and second element rows abut each other.

8. The image forming apparatus as defined in claim 1, wherein said grating light valve element includes a substrate and a plurality of microbridges provided on spacers on the substrate, and said grating light valve element reflects light emitted from a light source as a plane mirror when no voltage is applied and diffracts light emitted from a light source with said microbridge moving toward said substrate when a voltage is applied.

9. An image forming apparatus, comprising:

an image carrier having a movable surface;

exposure means for forming an electrostatic latent image on said image carrier, said exposure means including a light source for emitting light and an optical modulator for modulating light from said light source, the exposure means aligned with the image carrier to project a modulated light on said image carrier to form the electrostatic latent image thereon;

development means for developing the electrostatic latent image so as to form a visual image, wherein said development means is juxtaposed with the image carrier; and transfer means mounted in the apparatus for transferring the visual image from the image carrier and onto recording material, wherein:

said optical modulator comprises element row units including a first element row unit including at least one element row composed of a plurality of grating light valve elements and a second element row unit including at least one element row composed of a plurality of grating light valve elements, and the first element row unit forming a first row of projective light images on the image carrier, and the second element row unit forming a second row of projective light images on the image carrier; and wherein when the grating light valve elements are turned on in the first element row and in the second element row, the first row of projective light images is parallel to the second row of projective light images, and an end part of the first row projective light images overlaps an end part of the second row projective light images.

10. An image forming apparatus as set forth in claim 9, further comprising exposure control means in said apparatus for turning on the grating light valve elements projecting the end part of the first row projective light images, and for turning off the second grating light valve elements projecting the end part of the second row of projective light images.

11. An image forming apparatus as set forth in claim 10, further comprising projected light detecting means for detecting light projected by the element row units only during an exposure condition setting operation, wherein the grating light valve elements of the element row units are sequentially turned on and off, and wherein said projected light detecting means being provided in an overlap region, where the end part of the first row projective light images overlap the second row projective light images, wherein:

said projected light detecting means includes a light receiving unit having a width in a longitudinal direction of the first row projective light images that is smaller than a width of a projective light image projected by one grating light valve element in the longitudinal direction of the first row projective light image; and said exposure control means sets exposure conditions of said optical modulator in accordance with on and off states of the respective grating light valve elements and an output of said projected light detecting means during the exposure condition setting operation, and controls the on and off states of the respective grating light valve elements in accordance with the exposure conditions during image formation.

12. The image forming apparatus as set forth in claim 11, wherein:

when the grating light valve elements of the first element row unit are sequentially turned on from a first end of the unit to an opposite end during the exposure condition setting operation, said exposure control means stores as a first address a position of the grating light valve element which is turned on when projected light is detected by said projected light detecting means for a first time;

when the second grating light valve elements are sequentially turned on in a same direction as the first grating light valve elements are turned on during the exposure condition setting operation, said exposure control means stores as a second address a position of the second grating light valve element which is turned on when projected light is detected by said projected light detecting means for a first time; and during image formation, said exposure control means forbids turning on of (1) each grating light valve element of the first element row unit provided on a side of a first end grating light valve element with respect to the grating light valve element having the first address, the first end grating light valve element indicating the grating light valve element corresponding to an end of the first row projective light image on a side of the overlap region, and (2) each grating light valve elements of the second element row unit provided on a side of the second end grating light valve element with respect to the grating light valve element having the second address, the second end grating light valve element indicating the grating light valve element corresponding to an end of the second row projective light image on a side of the overlap region, and allows turning on of either the grating light valve element having the first address or the grating light valve element having the second address.

13. The image forming apparatus as set forth in claim 11, wherein:

when the first grating light valve elements are sequentially turned on in a first direction from a first end to an opposite end during the exposure condition setting operation, said exposure control means stores as a first address a position of the first grating light valve element which is turned on when projected light is detected by said projected light detecting means for a first time; and when the second grating light valve elements are sequentially turned on in an opposite direction to the first direction, said exposure control means holds a position of the second grating light valve element which is turned on when projected light is detected by said projected light detecting means for the first time, and the exposure control means checks whether projected light is detected by said projected light detecting means when a next second grating light valve element is turned on, and stores as a second address a position of the second grating light valve element which is turned on; and during the image formation, said exposure control means forbids turning on of (1) each grating light valve element of the first element row unit on a side of a first end grating light valve element with respect to the grating light valve element having the first address, the first end grating light valve element indicating the grating light valve element corresponding to an end of the first row projective light image on a side of the overlap region, and (2) each grating light valve elements of the second element row unit on a side of a second end grating light valve element with respect to the grating light valve element having the second address, the second end grating light valve element indicating the grating light valve element corresponding to an end of the second row projective light image on a side of the overlap region, and allows turning on of either the grating light valve element having the first address or the grating light valve element having the second address.

14. The image forming apparatus as set forth in claim 9, wherein said exposure means further includes light dividing means for dividing the light from said light source into two lights, and for projecting one of the two lights on the first element row unit while projecting another of said two lights on the second element row unit.

15. The image forming apparatus as set forth in claim 9, wherein:

the first element row unit includes a first (I) element row and a first (II) element row each having a plurality of the grating light valve elements, the first (I) element row is parallel to the first (II) element row, the grating light valve elements constituting the first (I) element row and the first (II) element row being staggered such that a line extending from a center of each element of the first (II) element row perpendicularly to a center line of the first (I) element row runs between neighboring grating light valve elements of the first (I) element row, and such that the grating light valve elements are provided at spaces, each space being smaller than a width of each grating light valve element; and the second element row unit includes a second (I) element row and a second (II) element row each having a plurality of the grating light valve elements, the second (I) element row and the second (II) element row are parallel to each other, the grating light valve elements constituting the second (I) element row and the second (II) element row being staggered such that a line extending from a center of each element of the second (I) element row perpendicularly to a center line of the second (II) element row runs between neighboring grating light valve elements of the second (II) element row, and each of the second (I) element row and the second (II) element row grating light valve elements are provided at spaces, each space being smaller than a width of a grating light valve element in a longitudinal direction of the third element row.

* * * * *